US006256904B1

(12) United States Patent
Kolb et al.

(10) Patent No.: US 6,256,904 B1
(45) Date of Patent: Jul. 10, 2001

(54) CONTROLLING FLOAT HEIGHT OF MOVING SUBSTRATE OVER CURVED PLATE

(75) Inventors: William Blake Kolb, St. Paul, MN (US); Marcio da Silveira Carvalho, Rio de Janeiro (BR); Gary Lee Huelsman, St. Paul, MN (US)

(73) Assignee: Imation Corp., Oakdale, MN (US)

( * ) Notice: Subject to any disclaimer, the term of this patent is extended or adjusted under 35 U.S.C. 154(b) by 0 days.

(21) Appl. No.: 09/073,524

(22) Filed: May 6, 1998

(51) Int. Cl.[7] ..... F26B 3/00
(52) U.S. Cl. ..... 34/448
(58) Field of Search ..... 34/444, 448, 459, 34/460, 62, 631, 623, 629

(56) References Cited

U.S. PATENT DOCUMENTS

| | | | |
|---|---|---|---|
| 3,577,653 | 5/1971 | McClenathan et al. . | |
| 3,668,788 | 6/1972 | Kobayashi . | |
| 3,962,799 | 6/1976 | Lapointe et al. . | |
| 4,365,423 | 12/1982 | Arter et al. | 34/23 |
| 4,790,468 | 12/1988 | Nakashima et al. | 226/97 |
| 4,999,927 | 3/1991 | Durst et al. | 34/23 |
| 5,242,095 | 9/1993 | Creapo et al. . | |
| 5,480,086 | 1/1996 | Nakashima et al. | 226/97 |
| 5,581,905 | 12/1996 | Huelsman et al. | 34/421 |
| 5,694,701 | 12/1997 | Huelsman et al. | 34/421 |

FOREIGN PATENT DOCUMENTS

| | | | |
|---|---|---|---|
| 196 05 195 A1 | 8/1997 | (DE) . | |
| 0 378 860 A2 | 7/1990 | (EP) . | |
| 0 770 731 A1 | 5/1997 | (EP) . | |
| 847548 | 9/1960 | (GB) . | |
| 1 401 041 | 7/1975 | (GB) | B01D/5/00 |

OTHER PUBLICATIONS

Cohen, Edward et al., Modern Coating and Drying Technology, *VCH Publishers*, Inc., pp. 267–302 (1992).

Eshel, A., "On Controlling the Film Thickness in Self–Acting Foil Bearings" *Journal of Lubrication Technology* , pp. 359–362, (Apr. 1970).

Eshel, A., "The Theory of the Infinitely Wide, Perfectly Flexible, Self–Acting Foil Bearing" *Transactions of the ASME, Journal of Basic Engineering*, vol. 87, Series D, No. 4, pp. 831–836 (Dec. 1965).

Kistler, S.F. et al., "Computational Analysis of Polymer Processing: Coating Flows", *Applied Science Publishers*, pp. 243–299.

Knox, Kenneth L. et al., "Fluid Effects Associated with Web Handling" *Ind. Eng. Chem. Process. Des. Develop.*, vol. 10, No. 2, pp. 201–205 (1971).

Kroll, K. et al., "Drying Since the Millenniums", Drying '80, *Proceedings of the Second International Symposium*, vol. 2, pp. 485–494.

*Primary Examiner*—Corrine McDermott
*Assistant Examiner*—Malik N. Drake
(74) *Attorney, Agent, or Firm*—William K. Weimer; Amelia A. Buharin

(57) ABSTRACT

A system, such as a gap drying system, moves a substrate having a substrate tension over a curved plate at a substrate speed such that the substrate floats over at least a region of substantially constant clearance ($H_0$) between the substrate and the curved plate. $H_0$ is controlled without adjusting the substrate speed and without adjusting the substrate tension.

55 Claims, 12 Drawing Sheets

CONTROLLING FLOAT HEIGHT OF MOVING SUBSTRATE OVER CURVED PLATE

TECHNICAL FIELD

The present invention generally relates to moving a substrate over a stationary plate, and more particularly relates to a method and apparatus for supporting and controlling a substrate traveling over a curved platen or plate where a thin layer of fluid is entrapped between the substrate and the curved plate, such as in an application for drying liquid coatings on a substrate.

BACKGROUND OF THE INVENTION

Drying coated substrates, such as webs, typically requires heating the coated substrate to cause liquid to evaporate from the coating. The evaporated liquid is then removed. In typical conventional impingement drying systems for coated substrates, one or two-sided impingement dryer technology is utilized to impinge air to one or both sides of a moving substrate. In such conventional impingement dryer systems, air supports and heats the substrate and can supply heat to both the coated and non-coated sides of the substrate. For a detailed discussion of conventional drying technology see E. Cohen and E. Gutoff, *Modern Coating and Drying Technology* (VCH publishers Inc., 1992).

In a gap drying system, such as taught in the Huelsman et al. U.S. Pat. No. 5,581,905 and the Huelsman et al. U.S. Pat. No. 5,694,701, which are herein incorporated by reference, a coated substrate, such as a web, typically moves through the gap drying system without contacting solid surfaces. In one gap drying system configuration, heat is supplied to the backside of the moving web to evaporate solvent and a chilled platen is disposed above the moving web to remove the solvent by condensation. In the gap drying system, the web typically is transported through the drying system supported by a fluid, such as air, which avoids scratches on the web.

As is the case for impingement dryer systems, previous systems for conveying a moving web without contacting the web typically employ air jet nozzles which impinge an air jet against the web. Most of the heat is typically transferred to the back side of the web by convection because of the high velocity of air flow from the air jet nozzles. Many impingement dryer systems can also transfer heat to the front side of the web. An impingement dryer system, the air flow is highly non-uniform, which leads to a non-uniform heat transfer coefficient. The heat transfer coefficient is relatively large in the region close to the air jet nozzle which is referred to as the impingement zone. The heat transfer coefficient is relatively low in the region far from the air jet nozzle where the air velocity is significantly smaller and tangential to the surface. The non-uniform heat transfer coefficient can lead to drying defects. In addition, it is difficult to uniformly control the amount of energy supplied to the backside of the web because the air flow is turbulent and complex. The actual effect of operating parameters on the drying rate can usually only be determined after extensive trial and error experimentation.

One method of obtaining a more uniform heat transfer coefficient to the web is to supply energy from a heated platen to the backside of the web by conduction through a fluid layer between the heated platen and the moving web. The amount of energy supplied to the backside of the web is a function of the heated platen temperature and thickness of the fluid layer between the heated platen and the moving web. In this situation, the heat transfer coefficient is inversely proportional to the distance between the heated platen and the moving web. Therefore, in order to obtain large heat transfer coefficients which are comparable to those obtained by air impingement drying systems, the distance between the moving web and the heated platen needs to be very small. In many applications, the web must not touch the heated platen to prevent scratches from occurring in the web. However, in some applications a degree of contact between the web and the heated platen is not detrimental to a product produced from the web coated material and high heat transfer rates are required or desired. In these other types of applications, it is advantageous to have the capability of metering away a sufficient amount of the fluid layer to enable the web to contact the heated platen.

For reasons stated above and for other reasons presented in greater detail in the Description of the Preferred Embodiments section of the present specification, a drying system is desired which forms a thin, uniform, and stable fluid layer between the moving web and the heated platen without forced fluid flow. In addition, there is a need for a drying system which can easily control the fluid layer thickness in order to adjust the heat transfer coefficient and thereby the drying rate required for specific products.

SUMMARY OF THE INVENTION

The present invention provides a system and method for moving a substrate having a substrate tension over a curved plate at a substrate speed such that the substrate floats over at least a region of substantially constant clearance ($H_0$) between the substrate and the curved plate. $H_0$ is controlled without adjusting the substrate speed and without adjusting the substrate tension.

In one embodiment, $H_0$ is controlled by removing fluid from between the substrate and the curved plate in the region of substantially constant clearance. In another embodiment, $H_0$ is controlled by injecting fluid in between the substrate and the curved plate in the region of substantially constant clearance.

The substrate moves through at least three regions including an inflow region in which the substrate approaches the curved plate, the region of substantially constant clearance, and an outflow region in which the substrate moves from the curved plate. In one embodiment, $H_0$ is controlled by controlling an adverse pressure gradient on the inflow region. In one form of this embodiment, an adjustable upstream idler holding a portion of the substrate is disposed upstream from the curved plate and is adjustable downward to reduce the length of the inflow region and is adjustable upward to increase the length of the inflow region. In another form of this embodiment, replaceable nose-pieces having varying geometry are used, such that one of the replaceable nose-pieces is disposed on an upstream edge of the curved plate to effectively form the front edge geometry of the curved plate. For example, the replaceable nose-pieces could have different radius of curvature or could have varying lengths. In another form of this embodiment, an adjustable flap is pivotally coupled to an upstream edge of the curved plate, such that an angle of the adjustable flap with respect to the curved plate is adjustable. In another form of this embodiment, an adjustable nose-piece is coupled to an upstream edge of the curved plate to effectively form an adjustable front edge geometry of the curved plate.

The system and method according the present invention can be implemented as a drying system, such as a gap drying system. In such a drying system according to the present invention, the substantially constant clearance $H_0$ between the moving substrate curved heated plate is controllable to more efficiently utilize the drying system. Adjusting $H_0$ also permits the heat transfer coefficient between the heated plate and the moving substrate to be adjusted. Adjusting the heat transfer coefficient enables the same coating line to be used for different products which have different drying requirements. In addition, the drying system according to the present invention can form a thin, uniform, and stable fluid layer between the moving substrate and the heated plate without requiring forced fluid flow.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Gap Drying System

Figure 1:
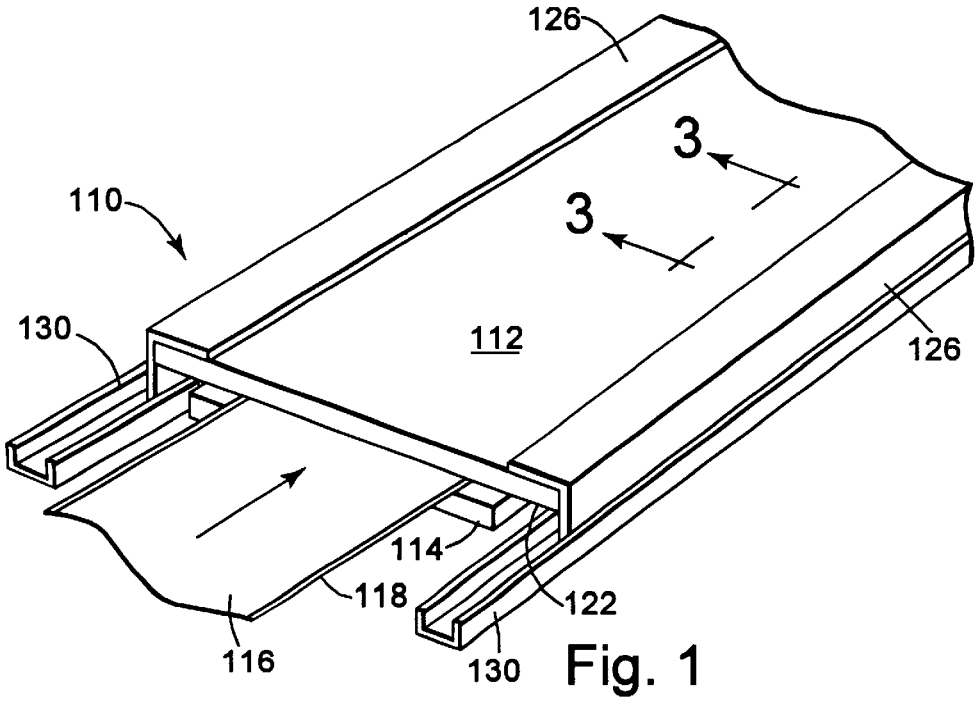
FIG. 1 is a perspective view of a gap drying system.
Figure 2:
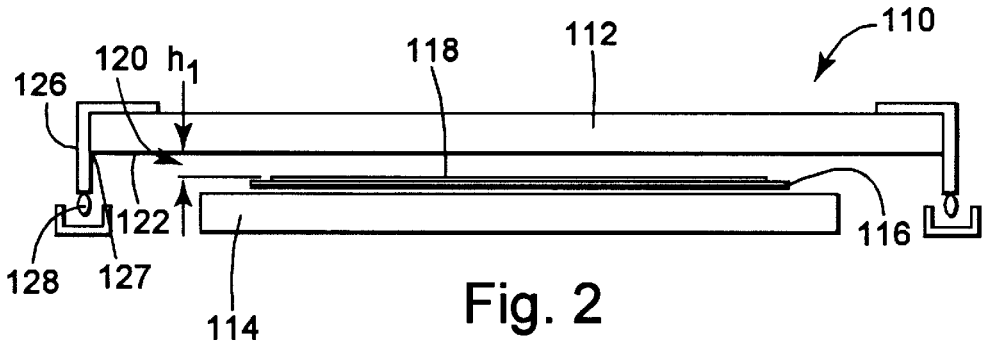
FIG. 2 is an end view of the gap drying system of FIG. 1.

A gap drying system is illustrated generally at 110 in FIGS. 1 and 2. Gap drying system 110 is similar to the gap drying systems disclosed in the above incorporated Huelsman et al. U.S. Pat. Nos. '905 and '701. Gap drying system 110 includes a condensing platen 112 spaced from a heated platen 114. In one embodiment, condensing platen 112 is chilled. A moving substrate or web 116, having a coating 118, travels between condensing platen 112 and heated platen 114. Some example substrate or web materials are paper, film, plastic, foil, fabric, and metal. Heated platen 114 is stationary within gap drying system 110. Heated platen 114 is disposed on the non-coated side of web 116, and there is typical a small fluid clearance, indicated at 132, between web 116 and platen 114. Condensing platen 112 is disposed on the coated side of web 116. Condensing platen 112, which can be stationary or mobile, is placed above, but near the coated surface. The arrangement of condensing platen 112 creates a small substantially planar gap 120 above coated web 116.

Heated platen 114 eliminates the need for applied convection forces below web 116. Heated platen 114 transfers heat substantially without convection through web 116 to coating 118 causing liquid to evaporate from coating 118 to thereby dry the coating. Heat typically is transferred dominantly by conduction, and slightly by radiation and convection, achieving high heat transfer rates. This evaporates the liquid from coating 118 on web 116. Evaporated liquid from coating 118 then travels across gap 120 defined between web 116 and condensing platen 112 and condenses on a condensing surface 122 of condensing platen 112. Gap 120 has a height indicated by arrows $h_1$.

Heated platen 114 is optionally surface treated with functional coatings. Examples of functional coatings include: coatings to minimize mechanical wear or abrasion of web 116 and/or platen 114; coatings to improve cleanability; coatings having selected emissimity to increase radiant heat transfer contributions; and coatings with selected electrical and/or selected thermal characteristics.

Figure 3:
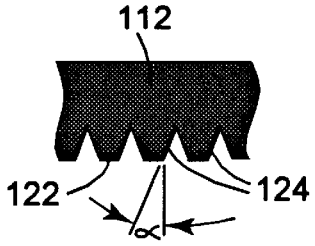
FIG. 3 is a partial cross-sectional view taken along line 3—3 of FIG. 1.

FIG. 3 illustrates a cross-sectional view of condensing platen 112. As illustrated, condensing surface 122 includes transverse open channels or grooves 124 which use capillary forces to move condensed liquid laterally to edge plates 126.

When the condensed liquid reaches the end of grooves 124, it intersects with an interface interior corner 127 between edge plates 126 and condensing surface 122. Liquid collects at interface interior corner 127 and gravity overcomes capillary force and the liquid flows as a film or droplets 128 down the face of the edge plates 126, which can also have capillary surfaces. Edge plates 126 can be used with any condensing surface, not just one having grooves. Condensing droplets 128 fall from each edge plate 126 and are optionally collected in a collecting device, such as collecting device 130. Collecting device 130 directs the condensed droplets to a container (not shown). Alternatively, the condensed liquid is not removed from condensing platen 112 but is prevented from returning to web 116. As illustrated, edge plates 126 are substantially perpendicular to condensing surface 122, but edge plates 126 can be at other angles with condensing surface 122. Edge plates 126 can have smooth, capillary, porous media, or other surfaces.

Heated platen 114 and condensing platen 112 optionally include internal passageways, such as channels. A heat transfer fluid is optionally heated by an external heating system (not shown) and circulated through the internal passageways in heated platen 114. The same or a different heat transfer fluid is optionally cooled by an external chiller and circulated through passageways in the condensing platen 112. There are many other suitable known mechanisms for heating platen 114 and cooling platen 112.

Figure 4:
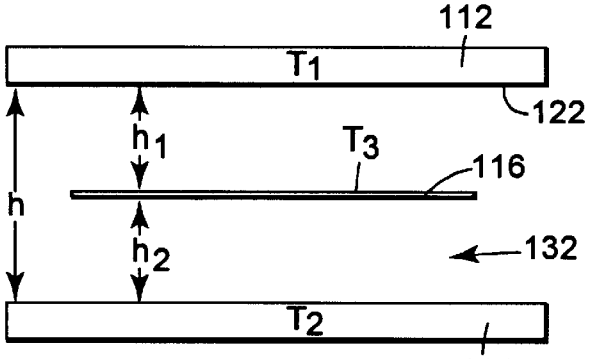
FIG. 4 is a schematic diagram side view illustrating process variables of the gap drying system of FIG. 1.

FIG. 4 illustrates a schematic side view of gap drying system 110 to illustrate certain process variables. Condensing platen 112 is set to a temperature $T_1$, which can be above or below ambient temperature. Heated platen 114 is set to a temperature $T_2$, which can be above or below ambient temperature. Coated web 116 is defined by a varying temperature $T_3$.

A distance between the bottom surface (condensing surface 122) of condensing platen 112 and the top surface of heated platen 114 is indicated by arrows h. A front gap distance between the bottom surface of condensing platen 112 and the top surface of the front (coated) side of web 116 is indicated by arrows $h_1$. A back clearance distance between the bottom surface of the backside (non-coated side) of web 116 and the top surface of heated platen 114 is indicated by arrows $h_2$. Thus, the position of web 116 is defined by distances $h_1$ and $h_2$. In addition, distance h is equal to $h_1$ plus $h_2$ plus the thickness of coated web 116.

A uniform heat transfer coefficient to web 116 is obtained by supplying energy to the backside of web 116 dominantly by conduction, and slightly by convection and radiation, through thin fluid layer 132 between heated platen 114 and moving web 116. Examples of fluid layer 132 include, but are not limited to air, ionized air, and nitrogen. The amount of energy supplied to the backside of web 116 is determined by platen temperature $T_2$ and the thickness of fluid layer 132, which is indicated by arrows $h_2$. The energy flux (Q) is given by the following Equation I:

$$Q=k_{FLUID}(T_2-T_3)/h_2 \qquad \text{Equation I}$$

Where, $k_{FLUID}$ is heat conductivity of fluid;

$T_2$ is the heated platen temperature;

$T_3$ is the web temperature; and $h_2$ is the back clearance distance between the bottom surface of the web and the top surface of the heated platen.

Equation I includes a simplified heat transfer coefficient which is equal to $K_{FLUID}/h_2$. According to the heat transfer coefficient portion of equation I, larger heat transfer coefficients are obtained with relatively small back clearance distances $h_2$. In many applications of gap drying system 110, web 116 must not touch heated platen 114 to prevent scratches from occurring in web 116. However, in some applications of gap drying system 110, a degree of contact between web 116 and heated platen 114 is not detrimental to a product produced from web 116 coated material and high heat transfer rates are required or desired. In these other types of applications of gap drying system 110, it is advantageous to have the capability of metering away a sufficient amount of fluid layer 132 to enable web 116 to contact heated platen 114.

Web Flotation Over Stationary Plates

Figure 5:
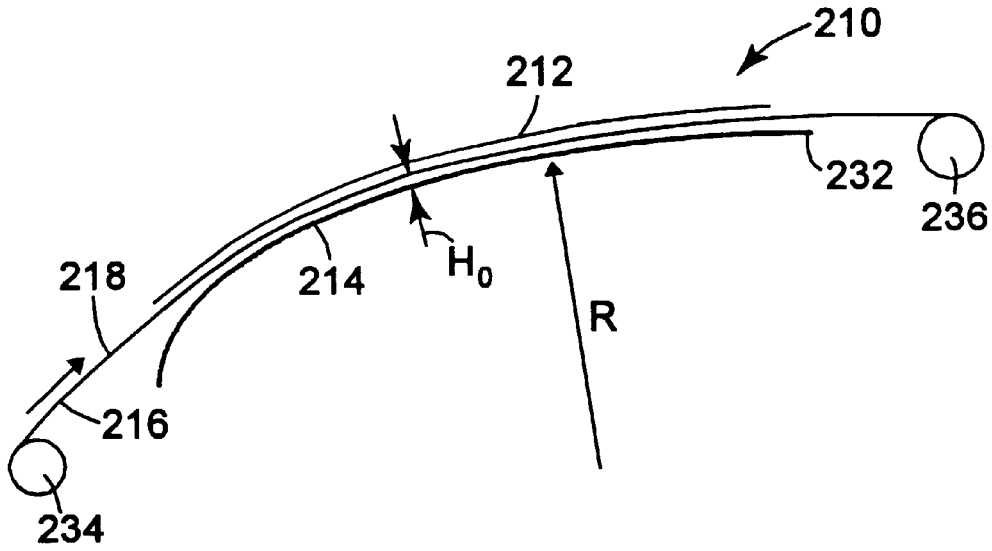
FIG. 5 is a schematic diagram side view of a gap drying system with a curved heated platen.

FIG. 5 illustrates, in schematic diagram form, a portion of a gap drying system 210. Gap drying system 210 is similar to gap drying system 110 illustrated in FIGS. 1 and 2. Gap drying system 210 includes a condensing platen 212 spaced from a heated curved platen 214. In one embodiment, condensing platen 212 is chilled. A moving substrate or web 216, having a coating 218, travels between condensing platen 212 and heated curved platen 214. Heated curved platen 214 is stationary within gap drying system 210. Heated curved platen 214 is disposed on the non-coated side of web 216, with a clearance $H_0$ between web 216 and platen 214. Condensing platen 212 is disposed on the coated side of web 216. Condensing platen 212, which can be stationary or mobile, is placed above, but near the coated surface. The arrangement of condensing platen 212 creates a small substantially planar gap above coated web 216.

Gap drying system 210 provides a uniform, stable, and thin fluid layer 232 in clearance $H_0$ between moving web 216 and heated curved platen 214. Curved platen 214 has a large radius of curvature indicated by arrow R, which allows gap drying system 210 to maintain uniform, stable and thin fluid layer 232 without forced fluid flow. Web 216 moves from an upstream idler roller 234 over curved platen 214 through to a downstream idler roller 236. Upstream idler roller 234, downstream idler roller 236, and curved platen 214 are positioned so that web 216 wraps around a portion of curved platen 214. Moving web 216 drags fluid to form thin fluid layer 232 which is under pressure between web 216 and curve platen 214. The amount of fluid in thin fluid layer 232 entrapped between web 216 and curved platen 214 is controlled by the speed of web 216, the line tension of web 216, and the platen geometry of curve platen 214.

When a flexible moving substrate, such as web 216, is traveling over a solid surface, such as the top surface of curved platen 214, a thin layer of fluid, such as thin fluid layer 232, is entrapped between the bottom surface of the substrate and the solid surface. This case of hydrodynamic lubrication is generally referred to as foil bearing.

Equation II expressed below is referred to as the Knox-Sweeney equation, and represents a theoretical model using Reynolds equation of lubrication to describe fluid flow between a moving web and a cylinder over which the web moves, with the assumptions of fluid incompressibility and an infinitely wide web of negligible stiffness. For derivation of Equation II see Eshel and Elrod, *The Theory of the Infinitely Wide, Perfectly Flexible, Self-Acting Foil Bearing,* Trans.ASME, Journal of Basic Engineering, Vol.87 at 831–836 (1965). For experimental validation of Equation II see L. K. Knox and T. L. Sweeney, *Fluid Effects Associated with Web Handling,* Ind. Eng. Chem. Process Design Dev., Vol. 10 at 201–205 (1971). According to Equation II, the relationship between the fluid thickness ($H_0$) and operating parameters is as follows:

$$H_0 = 0.643\left(R_0\left(6\frac{\mu V}{T}\right)\right)^{2/3} \qquad \text{Equation II}$$

where, $R_0$ is the radius of the cylinder;

$\mu$ is the fluid viscosity;

V is the web speed; and

T the tension of the web.

The above Equation II characterizes fluid flow between a moving web and a cylinder, but the clearance (i.e., fluid thickness $H_0$) predicted by the above equation II is much larger than the measured gap of a magnetic tape floating over a read/write head. This is because the geometry of the read/write head has corners which have an effect on the air film thickness between the magnetic tape and the read/write head, such that the air film thickness is sharply reduced as compared to the above equation II prediction for air film thickness over a cylinder shape. In Eshel, *On Controling the Film Thickness in Self-Acting Foil Bearing,* Journal of Lubrication Technology, Vol.92 at 359–362 (1970) lubrication approximation is used to show that the geometry of the head has a remarkable effect on the air film thickness. For example, the fluid film thickness $H_0$ is sharply reduced by corners in the solid over which a substrate travels.

Figure 6:
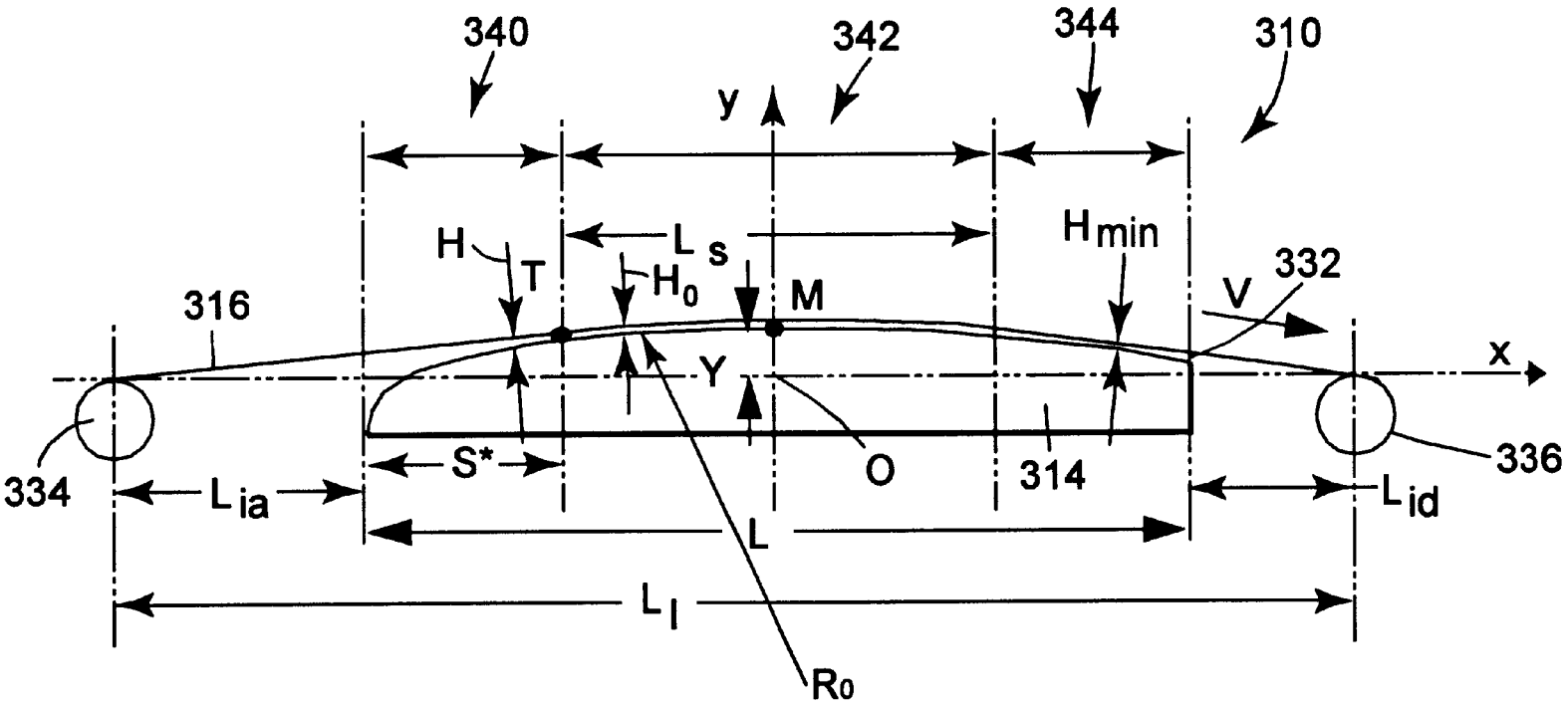
FIG. 6 is a schematic diagram side view of a system having a moving substrate over a stationary curved plate.

FIG. 6 illustrates, in schematic diagram form, a general configuration of a system 310 which provides a thin fluid layer 332 between a moving substrate or web 316 and a stationary curved platen or plate 314. In one embodiment, system 310 is a gap drying system, such as gap drying systems 110 of FIG. 1 and 210 of FIG. 5. When system 310 is implemented as a gap drying system, plate 314 is heated. In addition, system 310 can be implemented in numerous other types of drying systems which include a web 316 travelling over a heated plate 314. In addition, curved plate 314 in some embodiments of system 310 is chilled to remove energy from web 316. When plate 314 is heated or cooled it is used as a heat transfer member relative to web 316. In other embodiments of system 310, curved plate 314 is used for supporting web 316 for such applications as to flatten web 316 or to stiffen web 316. For example, such a system 310 can be used to minimize or substantially eliminate troughing in free-spans of the web by utilizing the radius plate 314.

Web 316 moves from an upstream idler roller 334 over curved plate 314 through to a downstream idler roller 336. Upstream idler roller 334, downstream idler roller 336, and curved plate 314 are positioned so that web 316 wraps around a portion of curved plate 314. As illustrated in FIG. 6, web 316 moves at a speed of V. Fluid dragged by moving web 316 generates pressure due to a converging channel formed between web 316 and curved plate 314. Fluid pressure deforms web 316. This fluid flow and web deformation are coupled in a behavior termed elastohydrodynamic behavior.

Upstream idler roller 334 and downstream idler roller 336 guide web 316 over curved plate 314. The position of curved plate 314 relative to upstream idler roller 334 and downstream idler roller 336 is characterized by the following notation. An X-coordinate axis is selected as a line that tangents the top of idler rollers 334 and 336. A Y-coordinate axis is selected as the line that is perpendicular to the X axis and intersects the X axis at a middle point 0 on the X axis. A distance between the centers of the idler rollers 334 and 336 along the X axis is indicated by arrows $L_1$. A distance from the center of upstream idler roller 334 to the upstream edge of curved plate 314 is indicated by arrows $L_{iu}$. A distance from the center of downstream idler roller 336 to the downstream edge of curved plate 314 along the X axis is indicated by arrows $L_{id}$. A length of curved plate 314 along the X axis is indicated by arrows L. A middle point M intersects the top surface of curved plate 314 and the Y axis. A distance along the Y axis between middle point M and midpoint 0 on the X is indicated by arrows Y. When Y is less than 0, web 316 does not touch plate 314. When Y is greater than 0, web 316 wraps around a portion of plate 314.

A tangent point T is where web 316 first touches plate 314 when web 316 is stopped or has a speed of 0. A distance parallel to the X axis from tangent point T to the upstream edge of curved plate 314 is indicated by arrows S*. The values of Y and S* are alternative ways of characterizing the relative position of plate 314 and idler rollers 334 and 336, because each value of Y corresponds to one value of S*. For example, if Y increases, curved plate 314 is pushed against web 316, and tangent point T moves towards the upstream edge of plate 314, which decreases the value of S*. A length indicated by arrows $L_s$ is the length that web 316 is in contact with plate 314 when web 316 is stopped (i.e., web speed is 0). $L_s$ is directly related to distance Y or distance S*.

Curved plate 314 has a large radius of curvature indicated by arrows $R_0$. A varying clearance between web 316 and plate 314 is indicated by arrows H. Fluid flow between web 316 and curved plate 314 is divided into three regions. An inflow region 340 is where web 316 approaches plate 314. A region of substantially constant clearance 342 is where the clearance H between web 316 and plate 314 is a substantially constant clearance, as indicated by arrows $H_0$. An outflow region 344 is where web 316 moves away from plate 314. Outflow region 344 is characterized by an undulation of web 316. A minimum clearance between web 316 and plate 314 is indicated by arrows $H_{min}$, which typically occurs adjacent to the exit or downstream edge of plate 314.

For the implementations where curved plate 314 is a heated plate, heat transfer from heated plate 314 to web 316 is substantially related to the value of substantially constant clearance $H_0$. As the speed (V) of web 16 increases, more fluid is dragged by moving web 16 which raises substantially constant clearance $H_0$. The relevant variables for this situation and their respective value ranges are listed in the following Table I:

TABLE I

| Variable | Symbol | usual units | range |
|---|---|---|---|
| Fluid density | $\rho$ | $g/cm^3$ | $10^{-3}$ |
| Fluid viscosity | $\mu$ | Poise | $2 \times 10^{-4}$ |
| web speed | V | ft/min | 20 to 1000 |
| Web tension | T | lb/in | 0.5 to 5 |
| Web thickness | t | Mils | 0.5 to 7 |
| Web density | $\rho_\omega$ | $g/cm^3$ | 1.3 |
| Elastic constants | $E/12(1 - v^2)$ | $N/m^2$ | $6 \times 10^8$ |
| Position of the plate | Y | In | 0 to 1.5 |

TABLE I-continued

| Variable | Symbol | usual units | range |
|---|---|---|---|
| Plate radius | $R_O$ | Ft | 40 to 120 |
| Plate length | L | Ft | 2 to 10 |
| Free span from idler to plate | $L_{iu}$ | In | 2.5 to 5 |

These variables can be combined into the following dimensionless groups:

$$\text{Reynolds Number: } Re \equiv \frac{\rho V H_0}{\mu}$$

$$\text{Tension Number: } \tau \equiv \frac{\mu V}{T}$$

$$\text{Elasticity Number: } N_{ES} \equiv \frac{D}{TR_0^2} = \frac{Et^3}{12(1-\upsilon^2)TR_0^2}$$

$$\text{Weight Number: } W \equiv \frac{\rho_w g t}{T / L_{iu}}$$

$$\text{Wrapping Angle: } \alpha \equiv \frac{L_S}{R_0}$$

$$\text{Dimensionless Length: } \frac{L}{R_0}$$

The Reynolds number represents a ratio of inertial to viscous forces, and has a number from approximately 1 to 10 for representative fluid flows. The tension number $\tau$ characterizes the ratio between the viscous force (pressure) action on moving web 316 to the tension T that is applied on moving web 316. Representative values of the tension number $\tau$ are from approximately $10^{-8}$ to $10^{-6}$. The elasticity number $N_{ES}$ represents the ratio between the moment required to bend web 316 to radius ($R_0$) of the curvature of plate 314 to the moment of the tension about the center of the radius plate 14. The radius of curvature of the plate 314 is quite large resulting in an elasticity number $N_{ES}$ being quite small in the order of $10^{-11}$. The weight number W measures the amount of bending of web 316 on a free span between upstream idler roller 334 and the upstream edge of plate 314. The wrapping angle $\alpha$ characterizes the relative position of plate 314 to web 316.

Figure 7A:
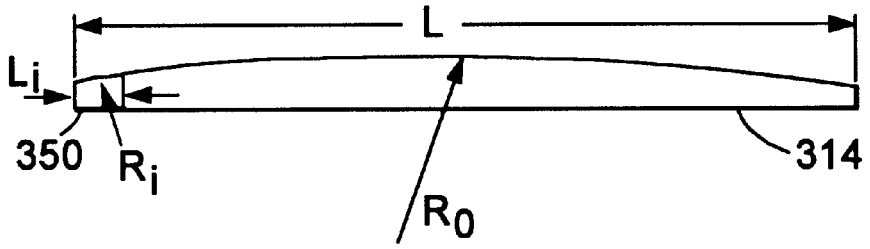
FIGS. 7A–7C are schematic diagram side views of curved plates which have entry section nose-pieces of different radius for the system of FIG. 6.
Figure 7B:
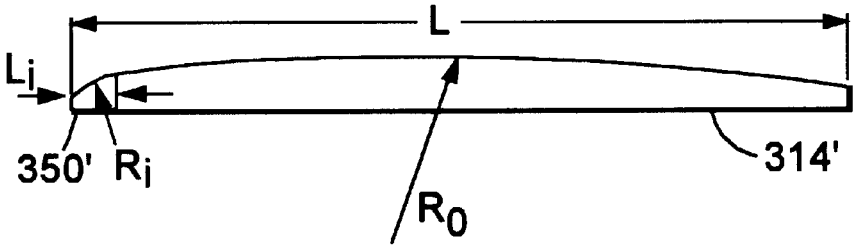
Figure 7C:
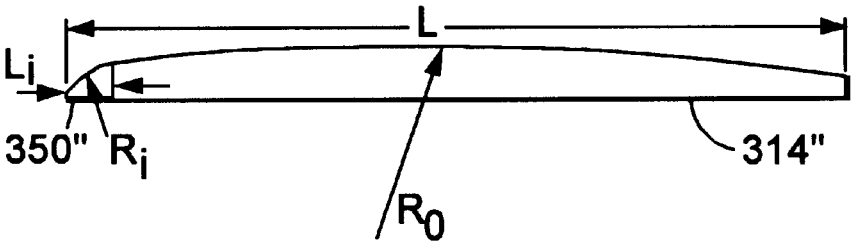

The substantially constant clearance $H_0$ can be controlled by the changing the entry section geometry of curved plate 314. FIGS. 7A–7C illustrate three different curved plates varying only in that their entry sections have nose-pieces with different radius. In FIG. 7A, a curved plate 314 has a radius $R_0$ equal to approximately 80 feet. The length L of plate 314 is approximately five feet. An entry section nose-piece 350 has a radius Ri which is also approximately 80 feet. Entry section nose-piece 350 has a length Li of approximately four inches.

In FIG. 7B, a curved plate 314' has a radius $R_0$ of approximately 80 feet and a total length L of approximately five feet. A nose-piece 350' has a radius Ri of approximately five feet and a length Li of approximately four inches. As illustrated in FIG. 7C, a curved plate 314" has a radius $R_0$ of approximately 80 feet and a length L of approximately 5 feet. An entry section nose-piece 350" has a length $L_i$ of approximately 4 inches with a radius $R_i$ of approximately two feet.

First, for a base comparison, various parameter relationships for system 310 obtained for web 316 floating over plate 314 of FIG. 7A are presented before comparing these parameter relationships to parameter relationships for system 310 with plates 314' and 314" of FIGS. 7B and 7C.

In the following graphical illustrations presented in FIGS. 8–16, theoretical predictions are made for a moving web 316 which is non-porous and the fluid over which web 316 moves is air. FIGS. 1–8 illustrate a theoretical model which use known equations to describe air motion and cylindrical shell approximation to model deformation of web 316. The air flow and web deformation in the illustrated theoretical model are assumed to be two-dimensional, such that the air and float height variation in the cross-web direction are neglected. In real applications, only a small amount of air escapes beneath the web through the sides. Experiments which included measuring the distance between a moving web and curved plate at different operating conditions and positions on the plate were performed to verify the accuracy of the theoretical two-dimensional model. In general, the predictions obtained based on the theoretical two-dimensional model as presented in FIGS. 8–16 agreed very closely to those measured experimentally, especially toward the center of the plate.

Although the two-dimensional model illustrated in FIGS. 8–16 incorporates several simplifying assumptions, such as neglecting cross-web air flow, not accounting for bagginess of the web, and not analyzing variations of flow height in the cross-web direction, the two-dimensional model illustrated in FIGS. 1–8 accurately represents overall features and trends of the elastohydrodynamic behavior of a moving web over a curved plate with a thin layer of fluid entrapped between the web and plate. In addition, the two-dimensional model illustrated in FIGS. 8–16 always assumes that there is an air layer between web 316 and curved plate 314. Therefore, the two-dimensional model cannot predict at what conditions web 316 touches plate 314, but the conditions at which web 316 touches plate 314 can be estimated by using threshold limits in the air layer thickness.

Figure 8:
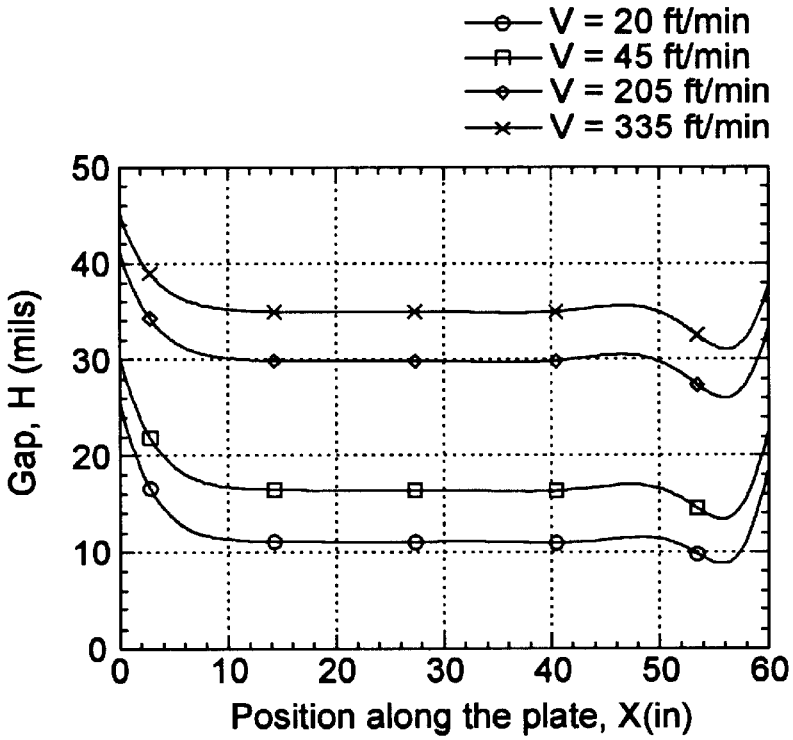
FIG. 8 is graph plotting clearance between a web and a curved plate versus position along the plate at different values of web speeds.

With the effect of the weight W of web 316 being neglected (i.e., W=0), FIG. 8 illustrates the clearance H between web 316 and plate 314 of FIG. 7A verses position along plate 314 at different web speeds V at a web tension T of 0.6 pounds per inch resulting in tension numbers $\tau$ from $2\times10^{-8}$ up to $3.4\times10^{-7}$. The elasticity number $N_{ES}$ is approximately equal to $1.6\times10^{-11}$ for the implementation illustrated in FIG. 8.

In the graphical illustration of FIG. 8, the position of plate 314 relative to the idler rollers 334 and 336 is fixed at represented by distance S* equals approximately 5 inches. As discussed above, either distance Y representing the coordinate of the middle point M of plate 314 or distance S* representing the position of the tangent point T of a stopped web 316 on plate 314 can be used to characterize the relative location of plate 314 and idler rollers 334 and 336. The distance S* is used herein in the presented graphical illustrations, because S* is easier to measure experimentally.

FIG. 8 illustrates the three regions of flow 340, 342, and 344 of system 310. In the inflow region 340, the clearance between web 316 and plate 314 decreases to the value of substantially constant clearance $H_0$, which for example, is approximately 30 mils for a web speed of 205 feet per minute. In outflow region 344, FIG. 8 illustrates the undulation of web 316, and illustrates where a minimum gap $H_{min}$ occurs close to the exit or downstream edge of plate 314. In addition, FIG. 8 illustrates that as web speed V increases more air is dragged by moving web 316 which correspondingly raises the value of substantially constant clearance $H_0$ which is approximately 12 mils for a velocity of 20 feet per minute, approximately 16 mils for V=45 feet per minute, approximately 30 mils for V=205 feet per minute and approximately 36 mils for V=335 feet per minute.

Figure 9:
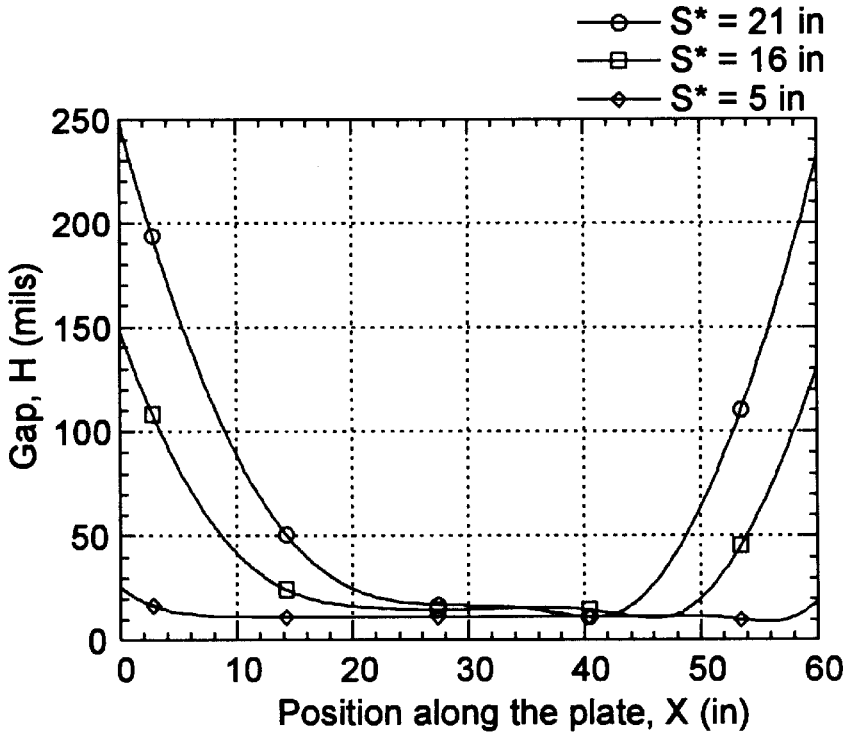
FIG. 9 is a graph plotting clearance between a moving web and a curved plate versus position along the plate at different values of web to plate tangent positions plate.

FIG. 9 illustrates how clearance H varies with different plate positions at different values of the position of tangent point T represented by distance S*. In FIG. 9, the Tension number $\tau=2\times10^{-8}$ for a tension T=0.6 lbs/in and a web speed V≈20 ft/min. In FIG. 9, the elasticity number $N_{ES}$ is equal to $1.6\times10^{-11}$. FIG. 9 illustrates three values of S*=21 inches, 16 inches, and 5 inches. As a tangent point T approaches the upstream edge of plate 314 S* is shorter, the region of substantially constant clearance 342 is extended in length, and the thickness of the air layer represented by the substantially constant clearance $H_0$ decreases.

Figure 10:
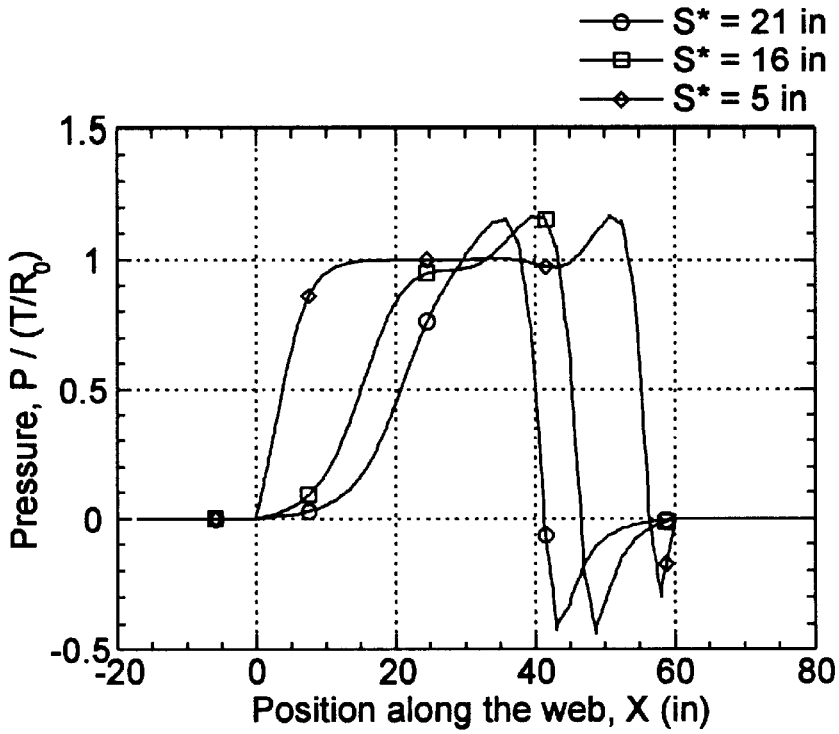
FIG. 10 is a graph plotting pressure distribution along a moving web versus position along the web at different values of web to plate tangent positions.

FIG. 10 illustrates pressure distribution along web 316 traveling over plate 314 of FIG. 7A for a Tension number $\tau=2\times10^{-8}$ and elasticity number $N_{ES}=1.6\times10^{-11}$. Three values of S* are plotted in FIG. 10, S* equal to 21 inches, 16, inches, and 5 inches. As illustrated in FIG. 10, a converging channel at inflow region 340 leads to a pressure build up in the flowing air. In the region of substantially constant clearance 342, pressure is almost constant and approximately equal to the tension T applied to web 316 divided by the radius $R_0$ of curvature of plate 314 (i.e., $P\cong T/R_0$). This type of flow in the region of substantially constant clearance 342 is approximately pure Couette flow. In pure Couette flow, channel height is linearly proportional to flow rate dragged by web 316. If the assumption is made that no air leakage occurs, flow rate in inflow region 340 is controlled by a combination of Couette and Poiseuille flow through the channel. From known elastohydrodynamic theory, it follows that a maximum pressure gradient in inflow region 340 is inversely proportional to the square of the flow rate. The larger the pressure gradient in inflow region 340, the more air is rejected and the smaller the flow rate through the region of substantially constant clearance 342. As S* is shortened, the length of the region of substantially constant clearance 342 is extended closer to the edge of the plate 314. Also as S* is shortened, the adverse pressure gradient at inflow region 340 increases, which leads to smaller air flow rates in the region of substantially constant clearance 342 which consequently leads to a smaller substantially constant clearance $H_0$ (i.e., a smaller float height), which is illustrated in FIG. 9.

Figure 11:
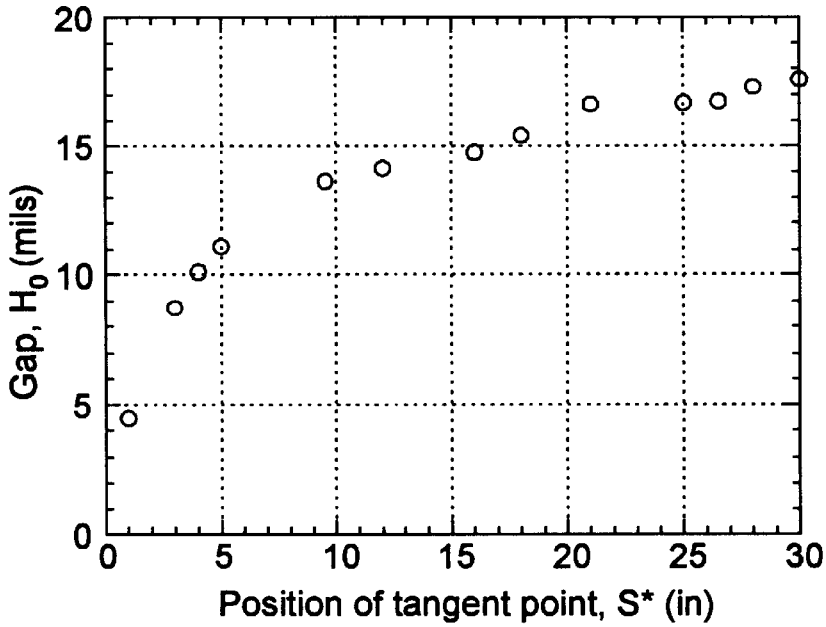
FIG. 11 is a graph plotting the clearance between a moving web and a curved plate at different web to plate tangent positions.

FIG. 11 illustrates the variation of substantially constant clearance $H_0$ (float height) between web 316 and plate 314 of FIG. 7A at different values of positions of tangent point T represented by distance S*. In FIG. 11, the Tension number is $\tau=2\times10^{-8}$ and the elasticity number $N_{es}=1.6\times10^{-11}$. As illustrated in FIG. 11, at S*=30 inches, Y=0 and web 316 is tangent to plate 314 at its middle point M. The graph illustrated in FIG. 11 can be divided into three distinct regions. The first region corresponds to a transition from a tangent web 316 to a web that is wrapped around the curved surface of plate 314. The substantially constant clearance $H_0$ falls slightly from approximately 18 mils to approximately 16.5 mils in this first region. In the second region, the effect of the position of the tangent point T represented by distance S* on the substantially constant clearance $H_0$ is relatively small. For example, as $H_0$ varies from approximately 16.5 mils to 14 mils, S* varies from 27 inches to 10 inches. As plate 314 is pushed further against web 316, S* falls, and air flow starts to be more effected by position of the tangent point as represented by distance S*. For example, in the third region, when S* is reduced from 10 inches to 2 inches away from the edge of plate 314, the substantially constant clearance $H_0$ is reduced from approximately 14 mils to approximately 4.5 mils.

Therefore, in the gap drying implementation of system 310, in order to take advantage of the entire length of heated curved plate 314 to increase web 316 temperature, the tangent point of web 316 on plate 314 should be quite close to the leading edge of plate 314. In other words, distance S* should be small. When distance S* is small, the position of the tangent point T on web 316 as represented by S* is critical to the value of the substantial constant clearance $H_0$. In addition, as illustrated in FIG. 11, the above equation II (Knox-Sweeney equation) cannot be used to accurately estimate the substantially constant clearance $H_0$ between web 316 and plate 314, because the Knox-Sweeney equation largely over predicts the thickness of the air layer represented by $H_0$. For example, at the conditions represented in FIG. 11, the Knox-Sweeney equation estimates $H_0$ to be approximately 15.4 mils.

As discussed above the substantially constant clearance $H_0$ between web 316 and plate 314 can be adjusted by controlling the pressure gradient at the leading (upstream) edge of plate 314. As illustrated in FIG. 11, one way of controlling the pressure gradient at the leading edge of plate 314 is to change the position at which web 316 approaches plate 314 (i.e., by adjusting S*). In certain situations, however, S* cannot be adjusted because the position at which web 316 approaches plate 314 will alter the overall web 316 path on a given coating line.

An alternative method of controlling the pressure gradient at the leading edge of plate 314 is to alter the geometry of the leading edge of the plate 314. A better understanding of how the leading edge geometry of plate 314 effects the substantially constant clearance $H_0$ (float height), is obtained by studying the variations in $H_0$ of web 316 travelling over the three different plates 314, 314' and 314" illustrated respectively in FIGS. 7A–7C. As discussed above curved plates 314, 314' and 314" all have lengths L=five feet and a main radius of curvature $R_0$=80 feet. The only difference between the geometry of the plates is the entry section nose-pieces 350, 350' and 350", which is where web 316 first approaches the plate. Each of the entry section nose-pieces 350, 350' and 350" have lengths of four inches, but have entry radius $R_i$ varying as follows: entry section nose-piece 350 having Ri=80 feet; entry section nose-piece 350' having $R_i$=five feet; and entry section nose-piece 350" having $R_i$=two feet. In plates 314, 314', 314" the transition between the entry sections 350, 350', and 350" and the rest of the curved plate is smooth such that the curved surfaces are tangent at the point where the entry section nose-piece meets the main plate section in three dimensions.

Figure 12:
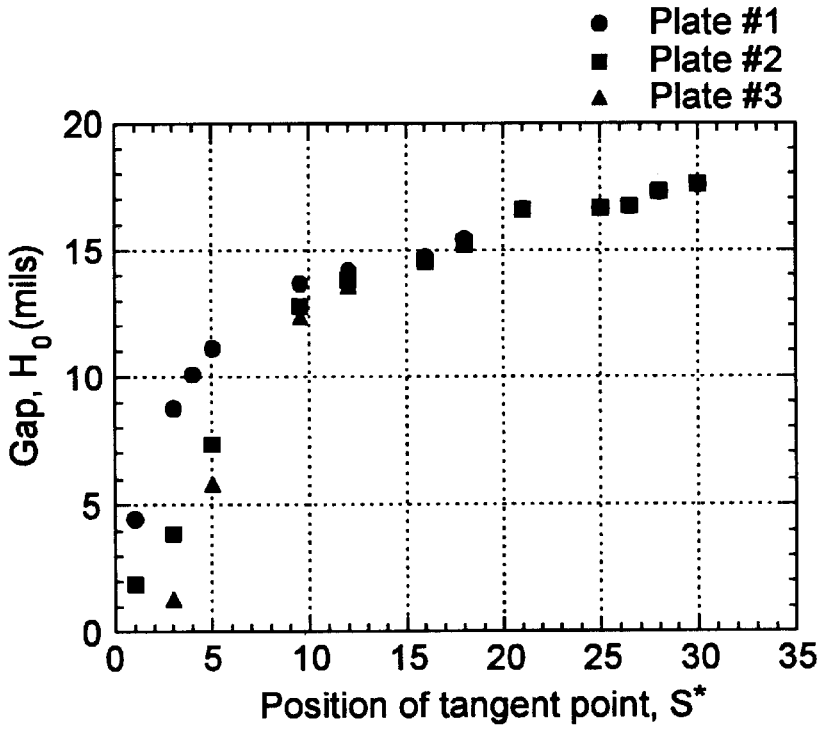
FIG. 12 is a graph illustrating the parameters plotted in FIG. 11 for three different plate geometries.

FIG. 12 illustrates the variation of the substantially constant clearance $H_0$ between web 316 and each of plates 314, 314', and 314" at different positions of tangent point T, as represented by distance S*. In FIG. 12, the tension number $\tau=2\times10^{-8}$ and the elasticity number $N_{ES}=1.6\times10^{-11}$. For plate 314 of FIG. 7A, the graph points of FIG. 11 are identical to the graph points for plate 314 illustrated in FIG. 12. At large values of S*, the air flow is not effected by the configuration of the entry section nose-piece and the graph points of all three plates 314, 314', and 314" are substantially the same. Nevertheless, as plates 314, 314', and 314" are pushed against web 316, and S* falls, the air flow starts to be effected by the geometry of the upstream edge of plates 314, 314', 314" which varies because of the varying entry section nose-pieces 350, 350', and 350". For example, at distance S*≦10 mils, the substantially constant clearance $H_0$ (float height) is more greatly dependent not only on distance S* but also on the geometry of the entry section nose-piece. At any fixed value of S*, the substantially constant clearance $H_0$ is maximum with plate 314 of FIG. 7A and minimum with plate 314" of FIG. 7C. For example at S* equals approximately five inches, the substantially constant clearance $H_0$ obtained with plate 314" of FIG. 7C is approximately half of the $H_0$ obtained with plate 314 of FIG. 7A.

Figure 13:
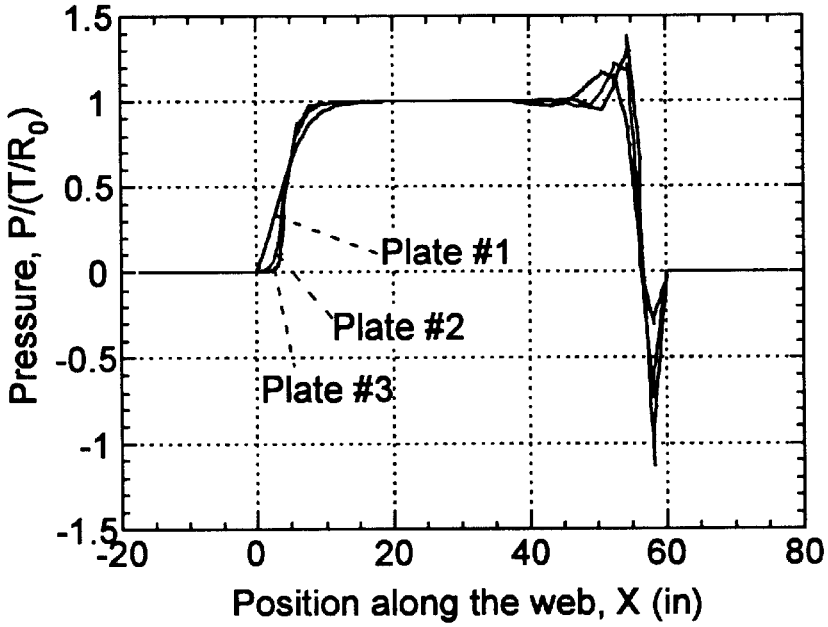
FIG. 13 is a graph plotting pressure distribution along three different plates versus different positions along a web moving over the plates.
Figure 14:
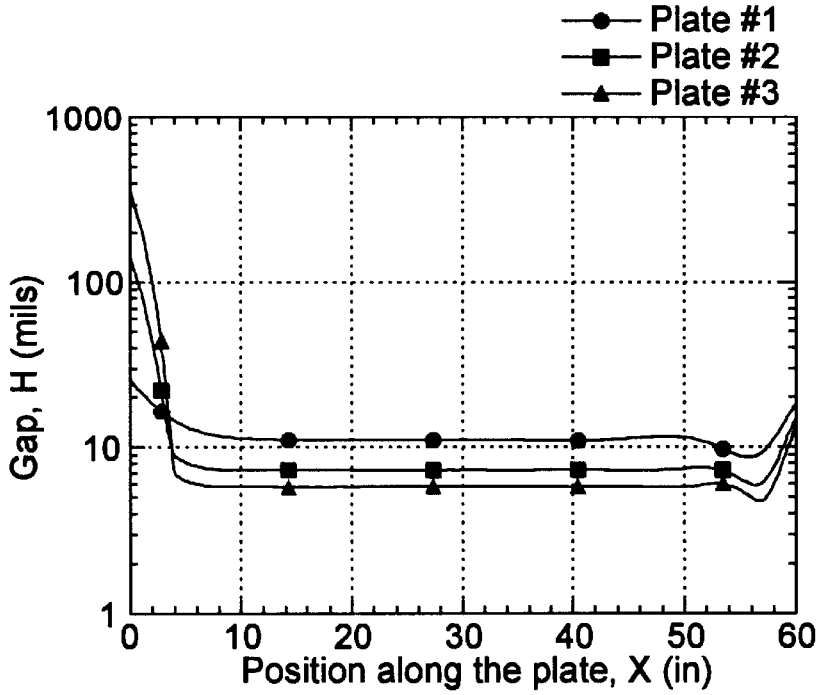
FIG. 14 is a graph plotting variations in a substantially constant clearance between a moving web and three different geometry plates.

FIG. 13 illustrates pressure distribution along plates 314, 314', 314" for different positions along web 316. FIG. 14 illustrates variations in substantially constant clearance $H_0$ between web 316 and plates 314, 314', and 314" for varying positions along the given plate. In FIGS. 13 and 14 the tension number $\tau=2\times10^{-8}$ and elasticity number $N_{es}$ is equal to $1.6\times10^{-11}$ and distance S* is equal to five inches. As illustrated in FIG. 14, the middle part of the air flow is characterized by an almost constant clearance channel formed between web 316 and the given plate 314, 314', or 314". As illustrated in FIG. 13, the pressure in this middle region of flow is virtually constant and is approximately the ratio between the web tension (T) and the radius ($R_0$) of the plate ($P\cong T/R_0$). Although the pressure along most of the plate is similar for all three plates, the pressure gradient at the inflow region is quite different, as illustrated in FIG. 13, which leads to the distinct difference in the clearance (H) illustrated in FIG. 14. The largest adverse pressure gradient at the inflow region is for plate 314" which results in the smallest substantially constant clearance $H_0$ (float height).

Figure 15:
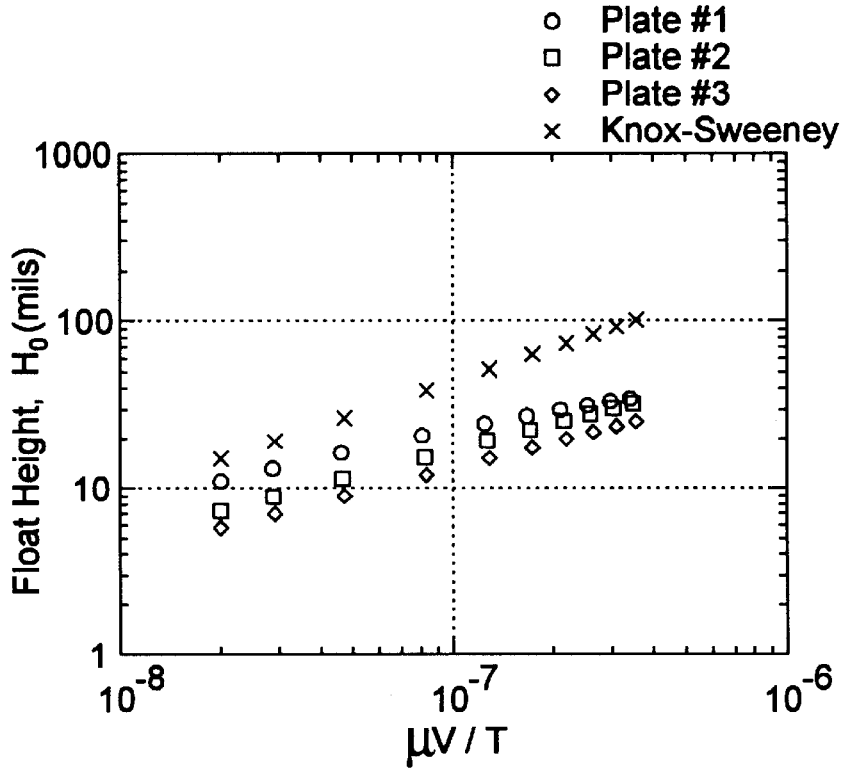
FIG. 15 is a graph plotting float height versus tension number for three different geometry plates and theoretical Knox-Sweeney equation values.

As indicated above, the tension number $\tau$ is directly proportional to web speed (V) and inversely proportional to web line tension (T) (i.e., $\tau=\mu V/T$). FIG. 15 illustrates the effect of variations in tension number $\tau$ on the substantially constant clearance $H_0$ for the three different plates 314, 314' and 314". Thus, FIG. 15 through the variations in tension number $\tau$ illustrates the effect of web speed V or line tension T on the substantially constant clearance $H_0$. In FIG. 15, the elasticity number $N_{ES}$ is equal to $1.6\times10^{-11}$ and distance S* is equal to five inches. FIG. 15 also illustrates predictions resulting from using the above Equation II (the Knox-Sweeney equation). As illustrated in FIG. 15, the substantially constant clearance $H_0$ increases as the tension number $\tau$ rises for all three plates 314, 314' and 314". A rising tension number $\tau$ equates to a higher web speed V or a lower web tension T for a given air viscosity. As the tension number $\tau$ increases, the entry section geometry effect on float height diminishes. In addition, as the tension number increases, the accuracy of the Knox-Sweeney equation is worse. For example, in FIG. 15, the Knox-Sweeney equation over predicts the float height by a factor as high as three.

Figure 16:
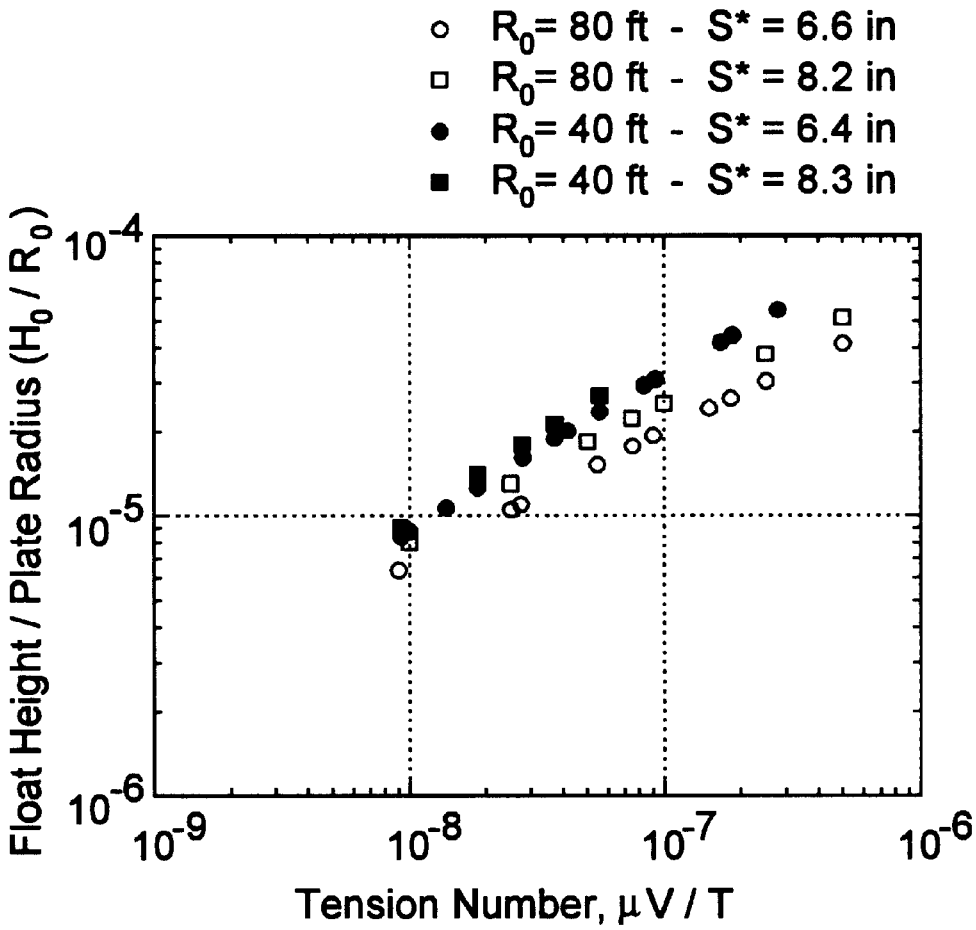
FIG. 16 is a graph plotting float height/plate radius versus tension number for curve plates of different main radius.

FIG. 16 illustrates the effect of main radius ($R_0$) of curvature of plate 314" of FIG. 7C on the substantially constant clearance $H_0$. In FIG. 16, plate 314" has a length L equal to five feet, and entry section nose-piece four inches long and a entry section radius of curvature $R_i$=2 ft. However, in FIG. 16 graph points are plotted for main radius of curvatures of $R_0$=80 ft. and $R_0$=40 ft. FIG. 16 plots the substantially constant clearance $H_0$ as a ratio of clearance over plate radius ($H_0/R_0$). FIG. 16 varies web speed V or web line tension T as represented by the tension number $\tau=\mu V/T$ at different tangent point positions represented by distance S*. The equation II above (Knox-Sweeney equation) predicts that the clearance between the web and the plate is a linear function of the plate radius. As such, the curves plotted in FIG. 16 for different plates according to the Knox-Sweeney equation would lie on top of each other. At all values of distance S*, the substantially constant clearance $H_0$ obtained with a plate 314" with a main radius of $R_0$=40 ft. is smaller than that obtained with a plate 314" having a main radius $R_0$ of 80 feet. However, this ratio is smaller than two and the curves do not superimpose each other. Thus, the Knox-Sweeney relationship predicts correct trends but is not correct for certain sets of conditions of interest, such as in applications for gap drying systems.

Float Height Control in Drying Systems

In a drying system, such as gap drying system 210 of FIG. 5, the substantially constant clearance $H_0$ (float height) between moving web 216 and curved stationary heated plate 214 is controllable according to the present invention to more efficiently utilize the drying system. Moreover, in a drying system of the present invention the float height can be easily controlled in order to adjust the heat transfer coefficient between the heated plate and the web which is extremely helpful because the same coating line is typically used for different products which have different drying requirements among other factors. The above graphical illustrations of FIGS. 8–16 and corresponding textural discussion illustrate mechanisms responsible for determining fluid layer thickness of the substantially constant clearance $H_0$ entrapped between a moving web (216, 316) and a curved plate (214, 314). The following plate designs and float height control are based on these mechanisms illustrated above.

Plate Radius of Curvature

As illustrated in FIG. 16, the radius of curved plate 214/314 has a great effect on the substantially constant clearance $H_0$ between web 216/316 and the curved plate. The larger the radius of curvature of plate 314, the larger the substantially constant clearance $H_0$. Even though the radius of the plate 314 typically cannot be used to adjust float height on-line because the plate would have to be changed between each run, the plate radius is an important parameter on which to base new plate designs. In addition, in one embodiment of plate 314, the actual main radius ($R_0$) of plate 314 is adjustable in real-time, such as, for example, in an embodiment where plate 314 is formed of sheet metal shaped in an adjustable radius cylindrical design. The plate radius determines the maximum float height which can be obtained at a given web speed V and web tension T. As illustrated in FIG. 11, the maximum float height ($H_0^{max}$ is approximately given by the above Equation II (Knox-Sweeney equation). Therefore, a minimum radius of curvature ($R_{min}$) of the curved plate is determined by the maximum desired float height as in the following equation III:

$$R_{\min} = 1.56\times\left(6\frac{\mu V}{T}\right)^{-2/3} H_0^{\max} \qquad \text{Equation III}$$

For example, according to equation III if the maximum float height $H_0^{max}$ is 20 mils for a given web line that runs at a web speed of V=150 ft/min and a web line tension T=0.6 lb/in, the minimum radius of curvature ($R_{min}$) of a given curved plate is approximately 40 ft. Another factor that sets a lower limit for the radius of curvature of a curved plate is the flexibility to install the plate in existing web paths. There is also an upper limit for the radius of curvature of the plate. The cross-web stiffness varies with the web curvature on the machine direction. The smaller the curvature, the stiffer the web, which results in the web being more resistant to out-of-plane deformation. If the radius of curvature of the plate is above a given value, the cross-web stiffness of the web becomes small and out-of-plane deformations are more likely to be formed in the web. In addition, if the radius curvature of the plate is above a given value, the distance between the web and the plate is not uniform and the web touches the plate leading to extremely high non-uniform heat transfer coefficients. Some factors that can effect the upper limit of the radius curvature of the plate are traming and leveling of the idler rollers and the plate.

Float Height Control

One way of changing the substantially constant clearance $H_0$ (float height) is by changing the web speed (V) or the web line tension (T). The substantially constant clearance $H_0$ (float height) increases with web speed V. Adjusting the web speed V is not the best way of controlling float height since it is usually determined by other process considerations such as a type of coating method, the length of the oven, and other such process considerations. The substantially constant clearance $H_0$ (float height) falls with increasing web line tension T. Nevertheless, the range of adjustment of web line tension T is somewhat limited because the line tension applied to the web is usually limited by various machine control and web handling parameters.

The present invention provides apparatus and methods of controlling the substantially constant clearance $H_0$ (float height) without adjusting web speed V or without adjusting web line tension T. In a first category of methods according to the present invention, substantially constant clearance $H_0$ (float height) is controlled by controlling the adverse pressure gradient on the entry section of the curved plate. In a second category of methods according to the present invention, the substantially constant clearance $H_0$ (float height) is controlled by removing entrained fluid between the web and curved plate in the region of substantially constant clearance. In a third category of methods according to the present invention, an active adjustment of the substantially constant clearance $H_0$ (float height) is made by injecting fluid between the web and the curved plate in the region of substantially constant clearance. The above methods for controlling float height can also be grouped between those that permit on-line, real time, and continuous control and those that only permit discrete off-line control. In addition, the float height adjustment mechanisms presented below can be controlled with feedback based controllers to permit the float height to be adjusted based on certain process variables, such as web temperature ($T_3$).

Figure 17:
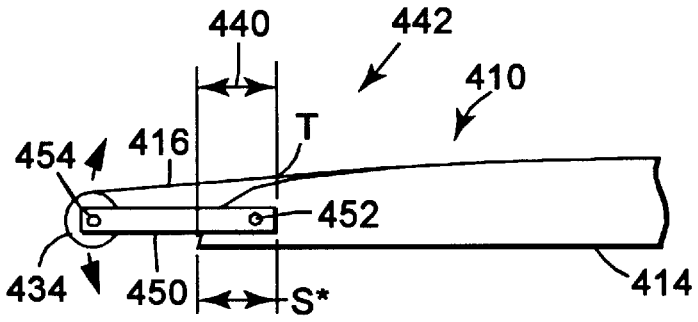
FIG. 17 is a schematic diagram side view of a web moving system according to the present invention which adjusts float height with an upstream idler roller.

System Configurations for Controlling the Adverse Pressure Gradient on the Entry Section of the Plate FIG. 17 illustrates, in schematic diagram form, a general configuration of a system 410 which provides a thin fluid layer 432 between a moving substrate or web 416 and a stationary curved platen or plate 414. In one embodiment, system 410 is a gap drying system, such as gap drying systems 110 of FIG. 1 and 210 of FIG. 5. When system 410 is implemented as a gap drying system, plate 414 is heated. In addition, system 410 can be implemented in numerous other types of drying systems which include a web 416 travelling over a heated plate 414. In addition, curved plate 414 in some embodiments of system 410 is chilled to remove energy from web 416. When plate 414 is heated or cooled it is used as a heat transfer member relative to web 416. In other embodiments of system 410, curved plate 314 is used for supporting web 416 for such applications as to flatten web 416 or to stiffen web 416. For example, such a system 410 can be used to minimize or substantially eliminate troughing in free-spans of the web by utilizing the radius plate 414.

Web 416 moves from an upstream idler roller 434 over curved plate 414 through to a downstream idler roller (not shown). The system 410 is similar in many respects to the above described system 310 illustrated in FIG. 6, such that web 416 wraps around a portion of curved plate 414 and fluid dragged by moving web 414 generates pressure due to a converging channel formed between web 416 and curved plate 414. Fluid pressure deforms web 416 and the fluid flow and web deformation are coupled in elastohydrodynamic behavior.

In system 410 upstream idler roller 434 is employed to change the position of the tangent point T where web 416 first touches curved plate 414 (with web speed V=0). As explained above S* is the horizontal distance from tangent point T to the upstream edge of curved plate 414. An upstream idler adjustment arm 450 is pivotally mounted to plate 414 at point 452 and its fixedly mounted to upstream idler roller 434 at point 454. In this way, upstream idler adjustment arm 450 can be moved up or down to adjust the position of upstream idler roller 434. Movement of upstream idler roller 434 upward increases the distance S* which effectively increases an inflow region 440 and decreases a region of substantially constant clearance 442. Correspondingly, movement of upstream idler adjustment arm 450 downward moves upstream idler 434 downward which shortens distance S* and decreases the length of inflow region 440 and increases the length of the region of substantially constant clearance 442.

Alternatively, upstream idler roller 434 is not attached to plate 414 with an upstream idler adjustment arm 450 but is adjustable by another suitable mechanism which moves upstream idler roller 434. For example, in one embodiment, upstream idler roller 434 is moved vertically up or down, and in another embodiment, is moved horizontally upstream or downstream. In fact, any suitable mechanism for adjusting distance S* can alternatively be employed in system 410 in place of upstream idler adjustment arm 450 to achieve the desired effect of controlling S*.

As graphically illustrated in FIGS. 11 and 12, as distance S* is lengthened, the substantially constant clearance $H_0$ (float height) is increased, and when distance S* is shortened, the substantially constant clearance $H_0$ is reduced. The raising of the upstream idler roller 434 leads to a smaller pressure gradient on the entry section of plate 414. As upstream idler roller 434 is lowered and the length of inflow region 440 is shortened, a larger pressure gradient is placed upon the entry section of plate 414. As illustrated in FIGS. 11 and 12, when distance S* is quite small, the substantially constant clearance $H_0$ (float height) is very sensitive to position of upstream idler roller 434. For example, under the parameter conditions identical to those illustrated in FIGS. 11 and 12, when distance S* moves from 10 to 2 inches, float height $H_0$ is reduced from 14 to 4.5 mils for a plate 414 having a radius $R_0$=80 ft, such as plate 314 of FIG. 7A.

System 410 covers continuously a very wide range of float heights. One limitation of system 410 is that if system 410 is used between curved plates in a multi-zone (or multi-plate) oven, changing the position of an upstream idler roller 434 effects the float heights of plates located upstream from that idler roller 434. The following systems and methods for adjustment of float height do not have this limitation and can be used in a multi-zone oven without such upstream influences.

Figure 18:
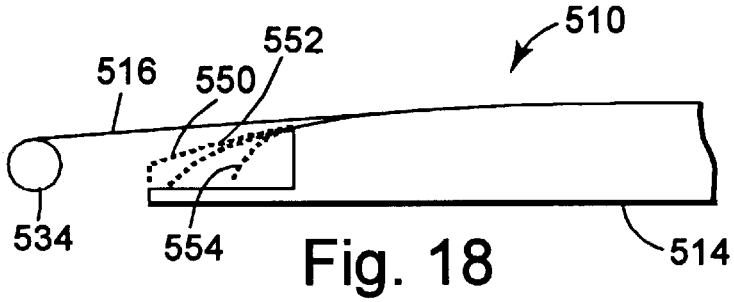
FIG. 18 is a schematic diagram side view of a web moving system according to the present invention having an adjustable float height through removable entry section nose-pieces.

FIG. 18 illustrates, in schematic diagram form, a general configuration of a system 510 which provides a thin fluid layer 532 between a moving substrate or web 516 and a stationary curved platen or plate 514. In one embodiment, system 510 is a gap drying system, such as gap drying systems 110 of FIG. 1 and 210 of FIG. 5. When system 510 is implemented as a gap drying system, plate 514 is heated. In addition, system 510 can be implemented in numerous other types of drying systems which include a web 516 travelling over a heated plate 514. In addition, curved plate 514 in some embodiments of system 510 is chilled to remove energy from web 516. When plate 514 is heated or cooled it is used as a heat transfer member relative to web 516. In other embodiments of system 510, curved plate 514 is used for supporting web 516 for such applications as to flatten web 516 or to stiffen web 516. For example, such a system 510 can be used to minimize or substantially eliminate troughing in free-spans of the web by utilizing the radius plate 514.

Web 516 moves from an upstream idler roller 534 over curved plate 514 through to a downstream idler roller (not shown). The system 510 is similar in many respects to the above described system 310 illustrated in FIG. 6, such that web 516 wraps around a portion of curved plate 514 and fluid dragged by moving web 514 generates pressure due to a converging channel formed between web 516 and curved plate 514. Fluid pressure deforms web 516 and the fluid flow and web deformation are coupled in elastohydrodynamic behavior.

Figure 18A:
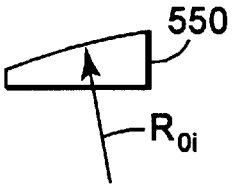
FIGS. 18A–18C are schematic diagram side view of entry section nose-pieces of different radius for the system of FIG. 18.
Figure 18B:
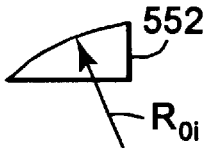
Figure 18C:
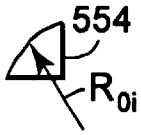

System 510 provides another method of changing the pressure gradient on the entry section of plate 514 without moving upstream idler roller 534. System 510 uses replaceable entry section nose-pieces 550, 552, and 554, illustrated respectively in FIGS. 18A, 18B, and 18C. The replaceable entry section nose-pieces 550, 552, and 554 provide a method of adjusting the geometry of the upstream edge of curved plate 514. In one embodiment, system 510 replaceable entry section nose-pieces 550, 552, 554 correspond respectively to nose-pieces 350 of FIG. 7A, 350' of FIG. 7B, and 350" of FIG. 7C. In this embodiment, replaceable entry section nose-piece 550 has a radius of curvature $R_i$ of 80 ft; replaceable entry section nose-piece 552 has a radius of curvature $R_i$ of 5 ft; and replaceable entry section nose-piece 554 has a radius of curvature $R_i$ of 2 ft.

Thus, as graphically illustrated in FIGS. 12, 13, 14 and 15 replaceable entry section nose-piece 550 obtains the largest substantially constant clearance $H_0$ (float height) and replaceable entry section nose-piece 554 obtains the smallest $H_0$ of the three nose-pieces.

Figure 19:
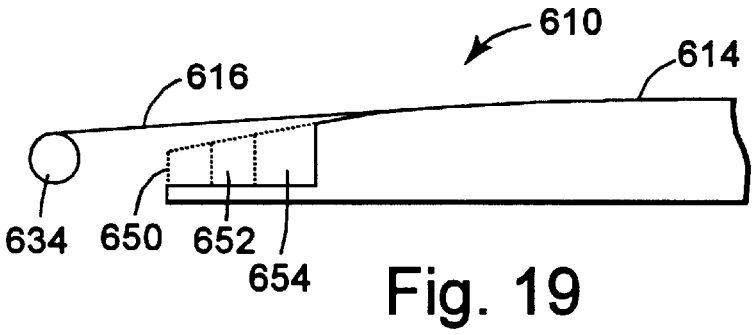
FIG. 19 is a schematic diagram side view of a web moving system according to the present invention having an adjustable float height through removable entry section nose-pieces.

FIG. 19 illustrates, in schematic diagram form, a general configuration of a system 610 which provides a thin fluid layer 632 between a moving substrate or web 616 and a stationary curved platen or plate 614. In one embodiment, system 610 is a gap drying system, such as gap drying systems 110 of FIG. 1 and 210 of FIG. 5. When system 610 is implemented as a gap drying system, plate 614 is heated. In addition, system 610 can be implemented in numerous other types of drying systems which include a web 616 travelling over a heated plate 614. In addition, curved plate 614 in some embodiments of system 610 is chilled to remove energy from web 616. When plate 614 is heated or cooled it is used as a heat transfer member relative to web 616. In other embodiments of system 610, curved plate 614 is used for supporting web 616 for such applications as to flatten web 616 or to stiffen web 616. For example, such a system 610 can be used to minimize or substantially eliminate troughing in free-spans of the web by utilizing the radius plate 614.

Web 616 moves from an upstream idler roller 634 over curved plate 614 through to a downstream idler roller (not shown). The system 610 is similar in many respects to the above described system 310 illustrated in FIG. 6, such that web 616 wraps around a portion of curved plate 614 and fluid dragged by moving web 614 generates pressure due to a converging channel formed between web 616 and curved plate 614. Fluid pressure deforms web 616 and the fluid flow and web deformation are coupled in elastohydrodynamic behavior.

Figure 19A:
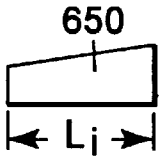
FIGS. 19A–19C are schematic diagram side views of straight entry section nose-pieces having different lengths for the system of FIG. 19.
Figure 19B:
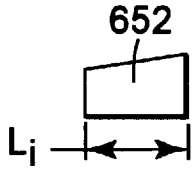
Figure 19C:
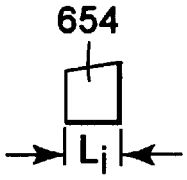

System 610 is similar to system 510, except that system 610 uses replaceable straight entry section nose-pieces 650, 652, and 654, illustrated respectively in FIGS. 19A, 19B, and 19C, rather than curved replaceable entry section nose-pieces 550, 552, and 554. Nevertheless, similar to the operation of the replaceable entry section nose-pieces 550, 552, and 554, the longest replaceable straight entry section nose-piece 650 yields the largest substantially constant clearance $H_0$ (float height) and the shortest replaceable straight entry section nose-piece 654 yields the smallest $H_0$ of the three replaceable nose-pieces.

One limitation of the system configurations of 510 and 610 is that only a discrete adjustment of float height is possible, unlike the continuous adjustment possible with system 410 illustrated in FIG. 17.

Figure 20:
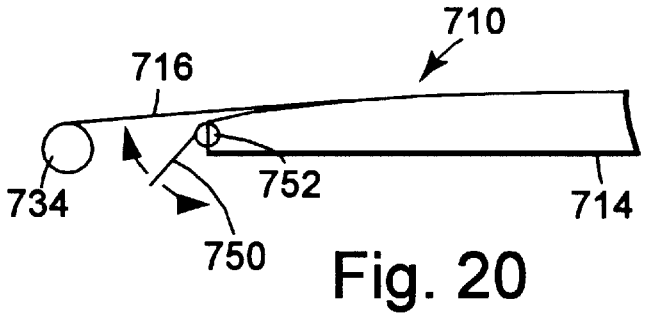
FIG. 20 is a schematic diagram side view of a web moving system according to the present invention having an adjustable flap for adjusting float height of the web.

FIG. 20 illustrates, in schematic diagram form, a general configuration of a system 710 which provides a thin fluid layer 732 between a moving substrate or web 716 and a stationary curved platen or plate 714. In one embodiment, system 710 is a gap drying system, such as gap drying systems 110 of FIG. 1 and 210 of FIG. 5. In addition, system 710 can be implemented in numerous other types of drying systems which include a web 716 travelling over a heated plate 714. In addition, curved plate 714 in some embodiments of system 710 is chilled to remove energy from web 716. When plate 714 is heated or cooled it is used as a heat transfer member relative to web 716. In other embodiments of system 710, curved plate 714 is used for supporting web 716 for such applications as to flatten web 716 or to stiffen web 716. For example, such a system 710 can be used to minimize or substantially eliminate troughing in free-spans of the web by utilizing the radius plate 714.

When system 710 is implemented as a gap drying system, plate 714 is heated. Web 716 moves from an upstream idler roller 734 over curved plate 714 through to a downstream idler roller (not shown). The system 710 is similar in many respects to the above described system 310 illustrated in FIG. 6, such that web 716 wraps around a portion of curved plate 714 and fluid dragged by moving web 714 generates pressure due to a converging channel formed between web 716 and curved plate 714. Fluid pressure deforms web 716 and the fluid flow and web deformation are coupled in elastohydrodynamic behavior.

System 710 includes an adjustable flap 750 to make similar types of adjustments as could be made with replaceable straight nose-pieces 650, 652, and 654 of FIGS. 19A–C. Adjustable flap 750 is pivotally mounted to curved plate 714 at point 752. In this way, adjustable flap 750 is adjustable up or down to have its angle with respect to plate 714 changed. When flap 750 is raised, the substantially constant clearance $H_0$ (float height) is increased. Correspondingly, when adjustable flap 750 is lowered towards its vertical position, float height $H_0$ is reduced.

One advantage of system 710 is that it provides continuous control of float height $H_0$ similar to system 410. One limitation of system 710 is that precise machining of the transition of adjustable flap 750 and the top surface of plate 714 is necessary in certain applications of system 710.

Figure 21:
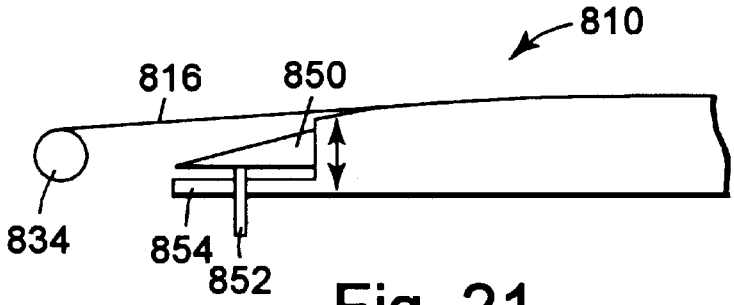
FIG. 21 is a schematic diagram side view of a web moving system according to the present invention having a slidable nose-piece for adjusting float height of the web.

FIG. 21 illustrates, in schematic diagram form, a general configuration of a system 810 which provides a thin fluid layer 832 between a moving substrate or web 816 and a stationary curved platen or plate 814. In one embodiment, system 810 is a gap drying system, such as gap drying systems 110 of FIG. 1 and 210 of FIG. 5. When system 810 is implemented as a gap drying system, plate 814 is heated. In addition, system 810 can be implemented in numerous other types of drying systems which include a web 816 travelling over a heated plate 814. In addition, curved plate 814 in some embodiments of system 810 is chilled to remove energy from web 816. When plate 814 is heated or cooled it is used as a heat transfer member relative to web 816. In other embodiments of system 810, curved plate 814 is used for supporting web 816 for such applications as to flatten web 816 or to stiffen web 816. For example, such a system 810 can be used to minimize or substantially eliminate troughing in free-spans of the web by utilizing the radius plate 814.

Web 816 moves from an upstream idler roller 834 over curved plate 814 through to a downstream idler roller (not shown). The system 810 is similar in many respects to the above described system 310 illustrated in FIG. 6, such that web 816 wraps around a portion of curved plate 814 and fluid dragged by moving web 814 generates pressure due to a converging channel formed between web 816 and curved plate 814. Fluid pressure deforms web 816 and the fluid flow and web deformation are coupled in elastohydrodynamic behavior.

System 810 includes vertically sliding entry section nose-piece 850. Sliding entry section nose-piece 850 includes an adjustable support mechanism 852, which for example, can be threadably mounted in a base portion 854 of plate 814. In this way, sliding entry section nose-piece can be adjusted vertically in a continuous manner similar to the adjustment of adjustable flap 750 of system 710. When sliding entry section nose-piece 850 is adjusted upward, the substantially constant clearance $H_0$ (float height) is increased and when sliding entry section nose-piece 850 is adjusted downward, float height $H_0$ is reduced.

Systems 510, 610, 710, and 810 of FIGS. 18–21 all employ mechanisms for altering the entry section geometry of the curved plate. Alternative embodiments of systems according to the present invention similar to systems 510, 610, 710, and 810 include more complex geometries in their plate designs and provide various mechanisms to adjust the more complex plate design geometries. For example, a more complex geometry plate could include, for example, three distinct radii, of which one or more are adjustable to alter the adverse pressure gradient on the inflow region.

Removing Fluid From Between Web and Plate

Figure 22:
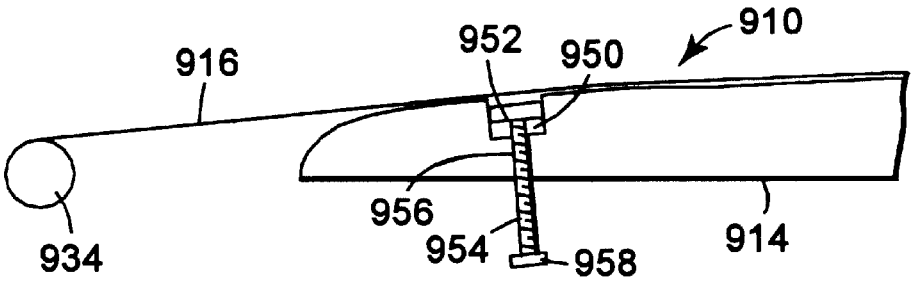
FIG. 22 is a schematic diagram side view of a web moving system according to the present invention which removes fluid from between a moving web and a curved plate to adjust float height of the web.

FIG. 22 illustrates, in schematic diagram form, a general configuration of a system 910 which provides a thin fluid layer 932 between a moving substrate or web 916 and a stationary curved platen or plate 914. In one embodiment, system 910 is a gap drying system, such as gap drying systems 110 of FIG. 1 and 210 of FIG. 5. When system 910 is implemented as a gap drying system, plate 914 is heated. In addition, system 910 can be implemented in numerous other types of drying systems which include a web 916 travelling over a heated plate 914. In addition, curved plate 914 in some embodiments of system 910 is chilled to remove energy from web 916. When plate 914 is heated or cooled it is used as a heat transfer member relative to web 916. In other embodiments of system 910, curved plate 914 is used for supporting web 916 for such applications as to flatten web 916 or to stiffen web 916. For example, such a system 910 can be used to minimize or substantially eliminate troughing in free-spans of the web by utilizing the radius plate 914.

Web 916 moves from an upstream idler roller 934 over curved plate 914 through to a downstream idler roller (not shown). The system 910 is similar in many respects to the above described system 310 illustrated in FIG. 6, such that web 916 wraps around a portion of curved plate 914 and fluid dragged by moving web 914 generates pressure due to a converging channel formed between web 916 and curved plate 914. Fluid pressure deforms web 916 and the fluid flow and web deformation are coupled in elastohydrodynamic behavior.

System 910 includes a notch 950 defined in the top surface of plate 914. A sliding plug 952 is slidably mounted into notch 950. An adjustable shaft 954 is fixedly attached to sliding plug 952. In one embodiment, adjustable shaft 954 is a threaded shaft which is threaded through a corresponding threaded portion 956 of plate 914. In this embodiment, a control knob 958 can be turned to move sliding plug 952 up or down towards or away from the top surface of plate 914.

System 910 permits removal of a part of the fluid entrained between web 916 and plate 914. Alternative embodiments of system 910 include multiple notches 950 for removing fluid entrained between web 916 and plate 914. When plug 952 is the same level as the top surface of plate 914, fluid leakage from the substantially constant clearance $H_0$ between web 916 and plate 914 is minimal and the float height ($H_0$) is substantially controlled by the pressure gradient at the entry section of plate 914. However, if plug 952 is lowered below the top surface of plate 914, some of the fluid entrained between web 916 and plate 914 in the substantially constant clearance $H_0$ flows in the cross-web direction and the total flow rate diminishes. With a diminished flow rate, the substantially constant clearance $H_0$ (float height) is also reduced. Thus, the amount of fluid removed can be controlled by the extent of the gap between the top surface of sliding plug 952 and web 916 with a larger gap resulting in a smaller float height. Also, if sliding plug 952 is raised above the top surface of plate 914, fluid is essentially scrapped from the fluid flowing between web 916 and plate 914, which diminishes flow rate and thereby also reduces substantially constant clearance $H_0$.

Injecting Fluid between Web and Plate

Figure 23:
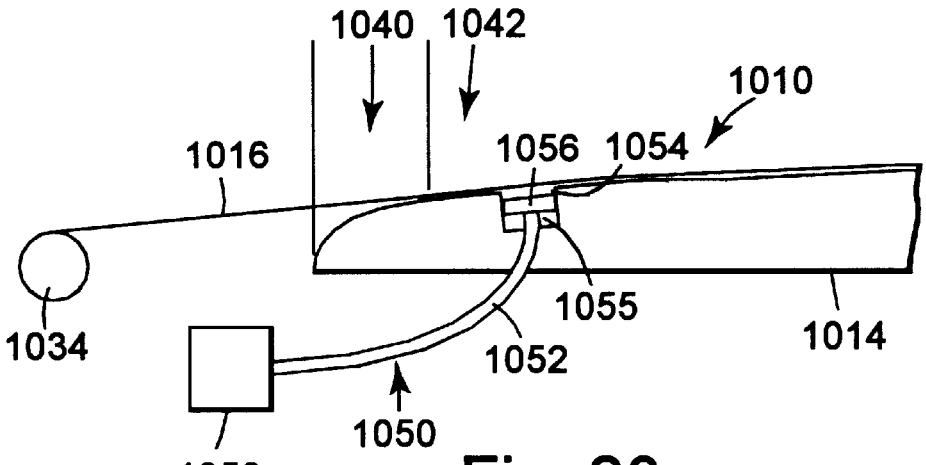
FIG. 23 is a schematic diagram side view of a moving web system according to the present invention which inserts fluid between a moving web and a curved plate to adjust float height of the web.

FIG. 23 illustrates, in schematic diagram form, a general configuration of a system 1010 which provides a thin fluid layer 1032 between a moving substrate or web 1016 and a stationary curved platen or plate 1014. In one embodiment, system 1010 is a gap drying system, such as gap drying systems 110 of FIG. 1 and 210 of FIG. 5. When system 1010 is implemented as a gap drying system, plate 1014 is heated. In addition, system 1010 can be implemented in numerous other types of drying systems which include a web 1016 travelling over a heated plate 1014. In addition, curved plate 1014 in some embodiments of system 1010 is chilled to remove energy from web 1016. When plate 1014 is heated or cooled it is used as a heat transfer member relative to web 1016. In other embodiments of system 1010, curved plate 1014 is used for supporting web 1016 for such applications as to flatten web 1016 or to stiffen web 1016. For example, such a system 1010 can be used to minimize or substantially eliminate troughing in free-spans of the web by utilizing the radius plate 1014.

Web 1016 moves from an upstream idler roller 1034 over curved plate 1014 through to a downstream idler roller (not shown). The system 1010 is similar in many respects to the above described system 310 illustrated in FIG. 6, such that web 1016 wraps around a portion of curved plate 1014 and fluid dragged by moving web 1014 generates pressure due to a converging channel formed between web 1016 and curved plate 1014. Fluid pressure deforms web 1016 and the fluid flow and web deformation are coupled in elastohydrodynamic behavior.

System 1010 includes a mechanism 1050 for injecting fluid into the substantially constant clearance $H_0$ between web 1016 and plate 1014. A hose 1052 is mounted into plate 1014 and provides fluid into a small notch 1054 through a nozzle 1056. A plug 1055 fits into notch 1054 and nozzle 1056 in mounted in plug 1055. A pump 1058 or other suitable mechanism pumps or injects fluid through hose 1052 in between web 1016 and plate 1014. When fluid is pumped in between web 1016 and plate 1014, the fluid under the web flows at a total flow rate which is increased which thereby also increases the substantially constant clearance $H_0$ (float height).

An alternative embodiment of system 1010 includes a mechanism 1050 for injecting fluid between web 1016 and plate 1014 along multiple positions of plate 1014. In addition, mechanism 1050 does not necessarily inject fluid into the region of substantially constant clearance 1042. For example, in one embodiment of system 1010, fluid is injected upstream in inflow region 1040. In fact, any suitable mechanism 1050 can be employed in system 1010 to inject fluid in the fluid flow between web 1016 and plate 1014 to increase total flow rate and thereby increase the substantially constant clearance $H_0$ (float height). One such mechanism 1050 includes a porous tube which provides fluid distribution for injecting fluid between web 1016 and plate 1014. Moreover, in the embodiment of system 1010 which includes a mechanism 1050 for injecting fluid in inflow region 1040, mechanism 1050 can be employed to inject fluid to actually adjust the position of tangent point T where web 1016 first touches curved plate 1014 (with web speed V equal to 0) as represented by distance S*. In such an embodiment of system 1010, injection of fluid in inflow region 1040 increases distance S* which effectively increases inflow region 1040 and decreases the region of substantially constant clearance 1042. As illustrated in FIGS. 11 and 12, as distance S* is lengthened, the substantially constant clearance $H_0$ (float height) is increased.

Conclusion

Systems 410, 510, 610, 710, 810, 910, and 1010 according to the present invention can all be implemented as drying systems, such as gap drying systems 110 or 210. In a drying system according to the present invention, the substantially constant clearance $H_0$ (float height) between the moving web and curved stationary heated plate is controllable to more efficiently utilize the drying system. Moreover, the present invention permits the substantially constant clearance to be easily adjusted in order to adjust the heat transfer coefficient between the heated plate and the moving web which is extremely helpful because the same coating line is typically used for different products which have different drying requirements.

The drying system according to the present invention permits formation of a thin, uniform, and stable fluid layer between the moving web and the heated plate without forced fluid flow. Avoiding fluid nozzles on the backside of the web brings several advantages such as the ones mentioned in the Background of the Invention section of the present specification. For example, the fluid flow resulting from fluid nozzles is highly non-uniform leading to non-uniform heat transfer coefficients, which may lead to drying defects. In addition, the installation cost of new ovens is dramatically reduced, since the cost of nozzles and fluid handling equipment is eliminated. The operating costs of the drying system according to the present invention is also largely reduced because the energy necessary to run the fluid handling equipment is eliminated and the amount of fluid that needs to be treated for solvent recovery purposes is much smaller than for a system having fluid nozzles.

Systems 410, 510, 610, 710, 810, 910, 1010, or other systems according to the present invention can be implemented in any general drying application which can include but are not limited to drying coated substrates useful for imaging media, data storage media, adhesive tapes, erasing materials, retro-reflective materials, repositionable adhesive notes, and the like. In addition, a drying process, such as performed by a system according to the present invention, is typically followed by a converting process which converts a wide web product into discrete units which can be packaged before being sold.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An apparatus for use with a substrate, comprising:

a plate;

means for moving a substrate at a substrate speed over the plate such that the substrate floats over at least a region of substantially constant clearance ($H_0$) between the substrate and the plate; and means controlling $H_0$ comprising the step of removing fluid from between the plate in the region of substantially constant clearance.

2. The apparatus of claim 1 wherein the means for controlling $H_0$ comprises means for controlling $H_0$ without adjusting speed and without adjusting tension of the substrate.

3. The apparatus of claim 1, wherein the plate has a curved shape and an adjustable radius.

4. The apparatus of claim 1, wherein the plate has a curved shape and is heated.

5. The apparatus of claim 1, wherein the plate has a curved shape and is chilled.

6. An apparatus for use with a substrate, comprising:

a plate;

means for moving a substrate at a substrate speed over the plate such that the substrate floats over at least a region of substantially constant clearance ($H_0$) between the substrate and the plate; and means for controlling $H_0$, wherein the region of substantially constant clearance includes a fluid layer and the means for controlling $H_0$ includes means for injecting fluid in between the substrate and the plate in the region of substantially constant clearance.

7. An apparatus for use with a substrate, comprising:

a plate;

means for moving a substrate at a substrate speed over the plate such that the substrate floats over at least a region of substantially constant clearance ($H_0$) between the substrate and the plate; and means for controlling $H_0$, wherein the substrate moves through at least three regions including an inflow region in which the substrate approaches the plate, the region of substantially constant clearance, and an outflow region in which the substrate moves from the plate, and wherein the means for controlling $H_0$ includes means for controlling an adverse pressure gradient on the inflow region.

8. The apparatus of claim 7 wherein the means for controlling the adverse pressure gradient on the inflow region includes:

means for injecting fluid into the inflow region.

9. The apparatus of claim 7 wherein the means for controlling the adverse pressure gradient on the inflow region includes:

means for adjusting the length of the inflow region.

10. The apparatus of claim 9 wherein the replaceable nose-piece have varying lengths.

11. The apparatus of claim 10 wherein the adjustable nose-piece is adjustable downward and upward.

12. The apparatus of claim 7 wherein the means for controlling the adverse pressure gradient on the inflow region includes:

an adjustable upstream idler holding a portion of the substrate and disposed upstream from the plate and being adjustable downward to reduce the length of the inflow region and being adjustable upward to increase the length of the inflow region.

13. The apparatus of claim 7 wherein the means for controlling the adverse pressure gradient on the inflow region includes:

a nose-piece disposed on an upstream edge of the plate to effectively form a front edge geometry of the plate.

14. The apparatus of claim 13 wherein the nose-piece comprises replaceable nose-pieces have different radii of curvature.

15. The apparatus of claim 7 wherein the means for controlling the adverse pressure gradient on the inflow region includes:

an adjustable flap rotatably coupled to an upstream edge of the plate, such that an angle of the adjustable flap with respect to the plate is adjustable.

16. The apparatus of claim 7 wherein the means for controlling the adverse pressure gradient on the inflow region includes:

an adjustable nose-piece coupled to an upstream edge of the plate to effectively form an adjustable front edge geometry of the plate.

17. A method comprising the steps of:

moving a substrate having a substrate tension over a plate at a substrate speed such that the substrate floats over at least a region of substantially constant clearance ($H_0$) between the substrate and the plate; and controlling $H_0$, wherein the region of substantially constant clearance includes a fluid layer, and wherein the step of controlling includes the step of removing fluid from between the substrate and the plate in the region of substantially constant clearance.

18. The method of claim 17 wherein the step of controlling includes the step of controlling $H_0$ without adjusting the substrate speed and without adjusting the substrate tension.

19. The method of claim 17, wherein the plate has a curved shape, further comprising the step of:

heating the curved plate.

20. The method of claim 17, wherein the plate has a curved shape, further comprising the step of:

chilling the curved plate.

21. A method comprising the steps of:

moving a substrate having a substrate tension over a plate at a substrate speed such that the substrate floats over at least a region of substantially constant clearance ($H_0$) between the substrate and the plate; and controlling $H_0$, wherein the region of substantially constant clearance includes a fluid layer and the step of controlling includes the step of:

injecting fluid between the substrate and the plate in the region of substantially constant clearance.

22. A method comprising the steps of:

moving a substrate having a substrate tension over a plate at a substrate speed such that the substrate floats over at least a region of substantially constant clearance ($H_0$) between the substrate and the plate; and controlling $H_0$, wherein in the moving step the substrate moves through at least three regions including an inflow region in which the substrate approaches the curved plate, the region of substantially constant clearance, and an outflow region in which the substrate moves from the curved plate, and wherein the step of controlling includes the step of:

controlling an adverse pressure gradient on the inflow region.

23. The method of claim 22, wherein the step of controlling the adverse pressure gradient on the inflow region includes the step of:

injecting fluid into the inflow region.

24. The method of claim 22 wherein the step of controlling the adverse pressure gradient on the inflow region includes the step of:

reducing the length of the inflow region.

25. The method of claim 22 wherein the step of controlling the adverse pressure gradient on the inflow region includes the step of:

increasing the length of the inflow region.

26. The method of claim 22 wherein the step of controlling the adverse pressure gradient on the inflow region includes the step of:

varying the geometry of an upstream edge of the plate.

27. The method of claim 26 wherein the step of varying includes the step of varying the radius of curvature of the upstream edge of the plate.

28. The method of claim 26 wherein the step of varying includes the step of varying the length of the upstream edge of the plate.

29. The method of claim 22 wherein the step of controlling the adverse pressure gradient on the inflow region includes the step of:

adjusting a flap rotatably coupled to an upstream edge of the plate to adjust an angle of the adjustable flap with respect to the plate.

30. The method of claim 22 wherein the step of controlling the adverse pressure gradient on the inflow region includes the step of:

adjusting an nose-piece coupled to an upstream edge of the plate.

31. An apparatus for use with a substrate, comprising:

a plate;

means for moving the substrate at a substrate speed over the plate such that the substrate floats over at least a region of substantially constant clearance ($H_0$) between the substrate and the plate, wherein the substrate moves through at least three regions including an inflow region in which the substrate approaches the plate, the region of substantially constant clearance, and an outflow region in which the substrate moves from the plate; and means for controlling $H_0$ by controlling an adverse pressure gradient on the inflow region.

32. The apparatus of claim 31 wherein the means for controlling includes:

a notch defined in a top surface of the plate; and a sliding plug that is slidably mounted in the notch.

33. A method comprising the steps of:

moving a substrate having a substrate tension over a plate at a substrate speed such that the substrate floats over at least a region of substantially constant clearance ($H_0$) between the substrate and the plate; and controlling $H_0$ removing fluid from between the substrate and the plate in the region of substantially constant clearance.

34. An apparatus for use with a substrate, comprising:

a plate;

means for moving the substrate at a substrate speed over the plate such that the substrate floats over at least a region of substantially constant clearance ($H_0$) between the substrate and the plate; and means for controlling $H_0$ by injecting fluid between the substrate and the plate in the region of substantially constant clearance.

35. A method comprising the steps of:

moving a substrate having a substrate tension over a plate at a substrate speed such that the substrate floats over at least a region of substantially constant clearance ($H_0$) between the substrate and the plate; and controlling $H_0$ by injecting fluid in between the substrate and the plate in the region of substantially constant clearance.

36. An apparatus for use with a substrate, comprising:

a plate;

means for moving the substrate at a substrate speed over the plate such that the substrate floats over at least a region of substantially constant clearance ($H_0$) between the substrate and the plate, wherein the substrate moves through at least three regions including an inflow region in which the substrate approaches the plate, the region of substantially constant clearance, and an outflow region in which the substrate moves from the plate; and means for controlling $H_0$ by controlling an adverse pressure gradient on the inflow region.

37. The apparatus of claim 36 wherein the means for controlling the adverse pressure gradient on the inflow region includes:

means for injecting fluid into the inflow region.

38. The apparatus of claim 36 wherein the means for controlling the adverse pressure gradient on the inflow region includes:

means for adjusting the length of the inflow region.

39. The apparatus of claim 36 wherein the means for controlling includes:

an adjustable upstream idler holding a portion of the substrate and disposed upstream from the plate and being adjustable downward to reduce the length of the inflow region and being adjustable upward to increase the length of the inflow region.

40. The apparatus of claim 36 wherein the means for controlling includes:

a nose-piece disposed on an upstream edge of the plate to effectively form a front edge geometry of the plate.

41. The apparatus of claim 40 wherein the nose-piece comprises replaceable nose-pieces have different radii of curvature.

42. The apparatus of claim 41 wherein the replaceable nose-pieces have varying lengths.

43. The apparatus of claim 36 wherein the means for controlling includes:

an adjustable flap rotatably coupled to an upstream edge of the curved plate, such that an angle of the adjustable flap with respect to the curved plate is adjustable.

44. The apparatus of claim 36 wherein the means for controlling includes:

an adjustable nose-piece coupled to an upstream edge of the plate to effectively form an adjustable front edge geometry of the plate.

45. The apparatus of claim 44 wherein the adjustable nose-piece is adjustable downward and upward.

46. A method comprising the steps of:

moving a substrate having a substrate tension over a plate at a substrate speed such that the substrate floats over at least a region of substantially constant clearance ($H_0$) between the substrate and the plate, wherein in the moving step the substrate moves through at least three regions including an inflow region in which the substrate approaches the plate, the region of substantially constant clearance, and an outflow region in which the substrate moves from the plate; and controlling $H_0$ by controlling an adverse pressure gradient on the inflow region.

47. The method of claim 46 wherein the step of controlling includes the step of:

reducing the length of the inflow region.

48. The method of claim 46 wherein the step of controlling includes the step of:

increasing the length of the inflow region.

49. The method of claim 46, wherein the step of controlling includes the step of:

injecting fluid in the inflow region.

50. The method of claim 46, wherein the plate has a curved shape, and wherein the step of controlling includes the step of:

varying the radius of curvature of an upstream edge of the curved plate.

51. The method of claim 50 wherein the step of varying includes the step of varying the radius of curvature of the upstream edge of the curved plate.

52. The method of claim 50 wherein the step of varying includes the step of varying the length of the upstream edge of the curved plate.

53. The method of claim 46, wherein the plate has a curved shape, and wherein the step of controlling includes the step of:

adjusting a flap rotatably coupled to an upstream edge of the curved plate to adjust an angle of the adjustable flap with resect to the curved plate.

54. The method of claim 46, wherein the plate has a curved shape, and wherein the step of controlling includes the step of:

adjusting a nose-piece coupled to an upstream edge of the curved plate.

55. A drying system for drying a coating on a first side of a substrate, wherein the substrate has a second side opposite the first side, comprising:

a heated plate disposed under the second side of the substrate;

a condensing plate disposed over the first side of the substrate;

means for moving the substrate at a substrate speed over the heated plate and under the condensing plate, such that the substrate floats over at least a region of substantially constant clearance ($H_0$) between the substrate and one of the heated plate and the condensing plate; and means for controlling $H_0$ comprising at least one of the following:

(i) means for removing fluid from between the substrate and the plate in the region of substantially constant clearance;

(ii) means for adding fluid in between the substrate and the plate in the region of substantially constant clearance; and (iii) means for controlling an adverse pressure gradient on an inflow region, the inflow region being a region in which the substrate approaches the plate.

* * * * *